US011630415B2

(12) United States Patent
Yan et al.

(10) Patent No.: US 11,630,415 B2
(45) Date of Patent: Apr. 18, 2023

(54) STORAGE COMPONENT DISASSEMBLY TOOLING

(71) Applicant: JIANGXI YIBO E-TECH CO. LTD., Xinyu (CN)

(72) Inventors: Mei Yan, Xinyu (CN); Zhisheng Cheng, Xinyu (CN); Liangliang Hu, Xinyu (CN); Zhibin Chen, Xinyu (CN); Lei Zhou, Xinyu (CN); Peng Jiang, Xinyu (CN)

(73) Assignee: JIANGXI YIBO E-TECH CO. LTD., Xinyu (CN)

( * ) Notice: Subject to any disclaimer, the term of this patent is extended or adjusted under 35 U.S.C. 154(b) by 0 days.

(21) Appl. No.: 17/534,526

(22) Filed: Nov. 24, 2021

(65) Prior Publication Data

US 2022/0171329 A1 Jun. 2, 2022

(30) Foreign Application Priority Data

| | | |
|---|---|---|
| Nov. 27, 2020 | (CN) | 202022801759.3 |
| Mar. 5, 2021 | (CN) | 202120480125.4 |
| Mar. 24, 2021 | (CN) | 202110313368.3 |
| Mar. 26, 2021 | (CN) | 202110328405.8 |
| Apr. 2, 2021 | (CN) | 202110362533.4 |

(51) Int. Cl.

| | |
|---|---|
| ***G03G 21/18*** | (2006.01) |
| ***G03G 15/00*** | (2006.01) |
| ***G03G 15/08*** | (2006.01) |

(52) U.S. Cl.
CPC ..... *G03G 21/1842* (2013.01); *G03G 15/0863* (2013.01); *G03G 15/0894* (2013.01); *G03G 21/181* (2013.01); *G03G 2215/00987* (2013.01)

(58) Field of Classification Search
CPC ..... G03G 15/0863; G03G 15/0894; G03G 21/181; G03G 21/1842; G03G 21/1878; G03G 2215/00987; B25B 27/00
See application file for complete search history.

(56) References Cited

U.S. PATENT DOCUMENTS

| | | | | |
|---|---|---|---|---|
| 11,061,363 | B1 * | 7/2021 | Yan | B25B 27/00 |
| 2004/0131383 | A1 | 7/2004 | Fujita et al. | |
| 2006/0171737 | A1 * | 8/2006 | Nishimura | G03G 21/181 399/109 |

(Continued)

FOREIGN PATENT DOCUMENTS

| | | | |
|---|---|---|---|
| CN | 201611427 | U | 10/2010 |
| CN | 102012667 | B | 7/2012 |

(Continued)

*Primary Examiner* — Sophia S Chen
(74) *Attorney, Agent, or Firm* — IPro, PLLC

(57) ABSTRACT

Discloses herein is a storage component disassembly tooling, for disassembling a storage component on a process cartridge. The process cartridge has a housing and a storage component mounting bracket on the housing for supporting the storage component. The storage component disassembly tooling has a drilling portion and a positioning portion. The positioning portion positions the storage component disassembly tooling on the housing of the process cartridge. The drilling portion moves relative to the positioning portion to destroy at least a part of the storage component mounting bracket.

11 Claims, 19 Drawing Sheets

(56) References Cited

U.S. PATENT DOCUMENTS

| | | | | |
|---|---|---|---|---|
| 2007/0025760 | A1* | 2/2007 | Williams | G03G 21/181 399/109 |
| 2008/0003014 | A1* | 1/2008 | Martin | G03G 21/181 399/109 |
| 2008/0008494 | A1* | 1/2008 | Martin | G03G 21/181 399/109 |
| 2018/0095415 | A1 | 4/2018 | Nishiyama et al. | |
| 2019/0227480 | A1 | 7/2019 | Fujiwara et al. | |
| 2021/0240126 | A1* | 8/2021 | Nagamine | G03G 21/1619 |

FOREIGN PATENT DOCUMENTS

| | | | | | |
|---|---|---|---|---|---|
| CN | 202649676 | U | | 1/2013 | |
| CN | 202649678 | U | | 1/2013 | |
| CN | 204178129 | U | | 2/2015 | |
| CN | 204719404 | U | | 10/2015 | |
| CN | 205157983 | U | | 4/2016 | |
| CN | 103293907 | B | | 6/2016 | |
| CN | 205539943 | U | | 8/2016 | |
| CN | 206249015 | U | | 6/2017 | |
| CN | 207164470 | U | | 3/2018 | |
| CN | 207326848 | U | | 5/2018 | |
| CN | 108803289 | A | | 11/2018 | |
| CN | 208689365 | U | | 4/2019 | |
| CN | 208689369 | U | | 4/2019 | |
| CN | 105629691 | B | | 11/2019 | |
| CN | 209634055 | U | | 11/2019 | |
| CN | 209657088 | U | | 11/2019 | |
| CN | 210283620 | U | | 4/2020 | |
| CN | 210666361 | U | | 6/2020 | |
| CN | 210742681 | U | | 6/2020 | |
| CN | 212256010 | U | | 12/2020 | |
| CN | 112269306 | A | | 1/2021 | |
| JP | 2000137375 | A | * | 5/2000 | G03G 15/0894 |

* cited by examiner

Partially enlarged schematic view of B

Partially enlarged schematic view of C

STORAGE COMPONENT DISASSEMBLY TOOLING

TECHNICAL FIELD

The present invention related to a storage component disassembly tooling and a method of disassembling a storage component.

BACKGROUND

In the prior art, a process cartridge is provided, which is detachably mounted in an electrophotographic imaging device with an electrical contact. It includes: a storage component, which can store related parameter information such as a model number and the number of printed pages of the process cartridge and can be in electrical contact with the electrical contact to establish a communication connection with the electrophotographic imaging device; and a storage component mounting bracket for mounting the storage component. Specifically, in the process cartridge, the storage component is adhered to the storage component mounting bracket by epoxy resin glue, contact parts of the storage component and the storage component mounting bracket are all substantially covered by the epoxy resin glue, and after the epoxy resin glue is cured, the storage component is very firmly adhered to the storage component mounting bracket.

When the storage component needs to be removed and reused, since the storage component is firmly adhered to the storage component mounting bracket, it is not easy to remove the storage component. For this, there are currently no better methods and tools on the market.

SUMMARY

Disclosed herein is a storage component disassembly tooling, for disassembling a storage component on a process cartridge, the process cartridge comprising a housing and a storage component mounting bracket on the housing for supporting the storage component, the storage component disassembly tooling comprising: a drilling portion, and a positioning portion; wherein the positioning portion is configured to position the storage component disassembly tooling on the housing of the process cartridge, and the drilling portion is configured to move relative to the positioning portion to destroy at least a part of the storage component mounting bracket.

In an aspect, the drilling portion comprises a cutting portion having a cutter edge, and the cutting portion is configured to destroy the part of the storage component mounting bracket using the cutter edge.

In an aspect, the cutter edge is configured to destroy the part of the storage component mounting bracket by cutting into the storage component mounting bracket in a non-rotating posture.

In an aspect, the drilling portion further comprises a squeezing portion configured to push the storage component out of the storage component mounting bracket.

In an aspect, the cutter edge has a cutter tip, and the cutter tip and the squeezing portion are transitioned by an inclined surface.

In an aspect, the storage component mounting bracket comprises a support portion for supporting the storage component, and when the storage component disassembly tooling is positioned on the process cartridge, at least a part of the squeezing portion is located on a downstream side of the support portion along an arrangement direction of the support portion and the storage component when viewed along a direction perpendicular to a thickness direction of the storage component.

In an aspect, the positioning portion further comprises a bonding portion configured to bond to the housing of the process cartridge, and configured to prevent the positioning portion from displacing relative to the housing when the cutting portion destroys the storage component mounting bracket.

In an aspect, the storage component disassembly tooling further comprises an opening, wherein when the storage component disassembly tooling is positioned on the housing, the storage component is exposed through the opening.

In an aspect, the storage component disassembly tooling further comprises a handle and an external thread connected to the handle, wherein the positioning portion comprises an internal thread matching the external thread, and wherein the handle, when rotated, is configured to cause the external thread to engage the internal thread and force the drilling portion to drill into the storage component mounting bracket.

In an aspect, the handle and the external thread are connected and form a T-shaped structure.

In an aspect, the storage component disassembly tooling further comprises a polishing portion having a rough surface for polishing the storage component removed from the process cartridge.

DETAILED DESCRIPTION

In order to make the objectives, technical solutions and technical effects of the embodiments of the present invention clearer, the technical solutions of the process cartridge of the present invention will be clearly and completely described below in conjunction with the drawings. Obviously, the described embodiments are only preferred embodiments of the present invention, rather than all the embodiments. Based on the embodiments of the present invention, other embodiments obtained by those skilled in the art without creative efforts all belong to the scope of protection of the present invention.

Embodiment 1

Figure 2:
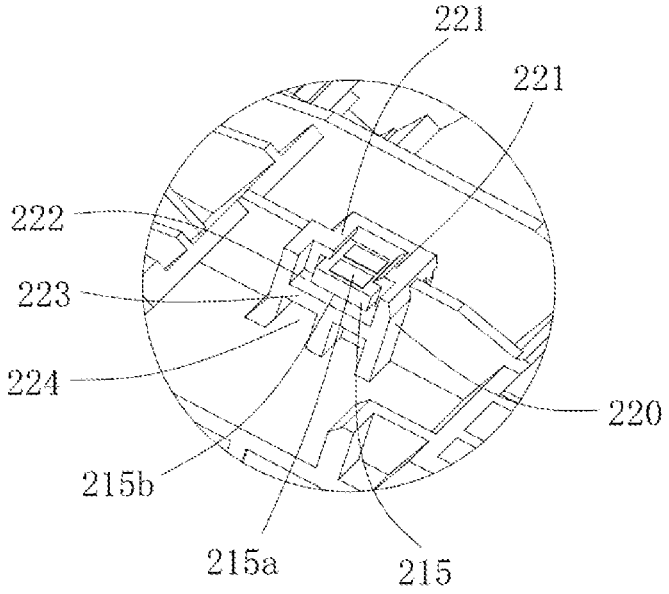
FIG. 2 is a partially enlarged schematic view of a portion in circle B in FIG. 1, showing a storage component mounting bracket in Embodiment 1 of the present invention.
Figure 3:
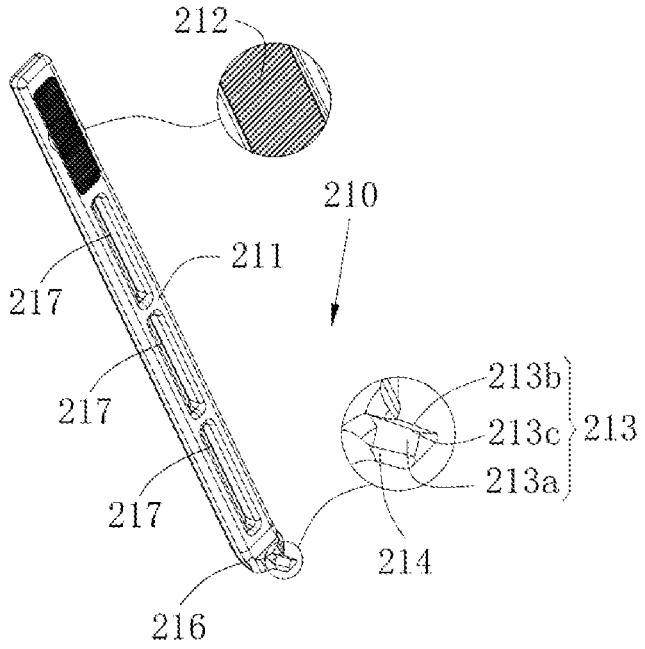
FIG. 3 is a schematic view of a storage component disassembly tooling in Embodiment 1 of the present invention.
Figure 4:
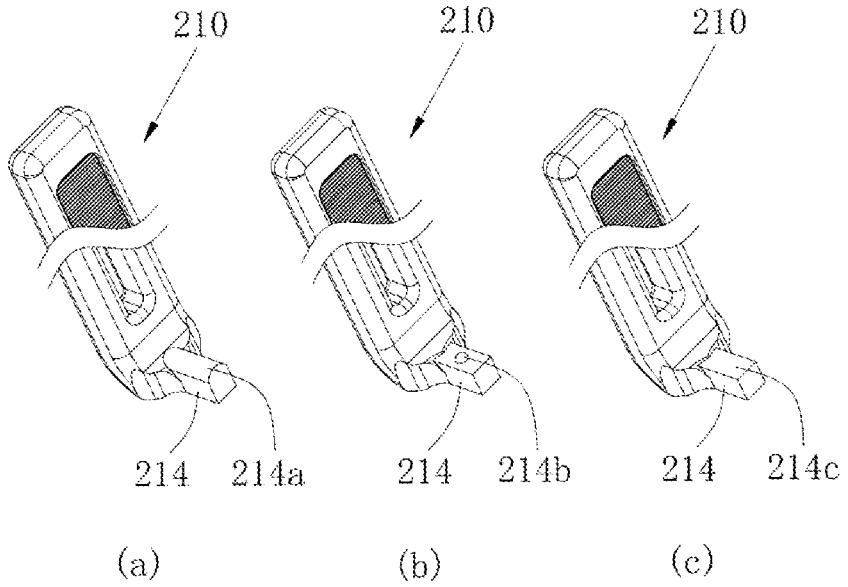
FIG. 4 is a schematic view of an arc portion, wave point portion and flat portion in Embodiment 1 of the present invention.
Figure 5:
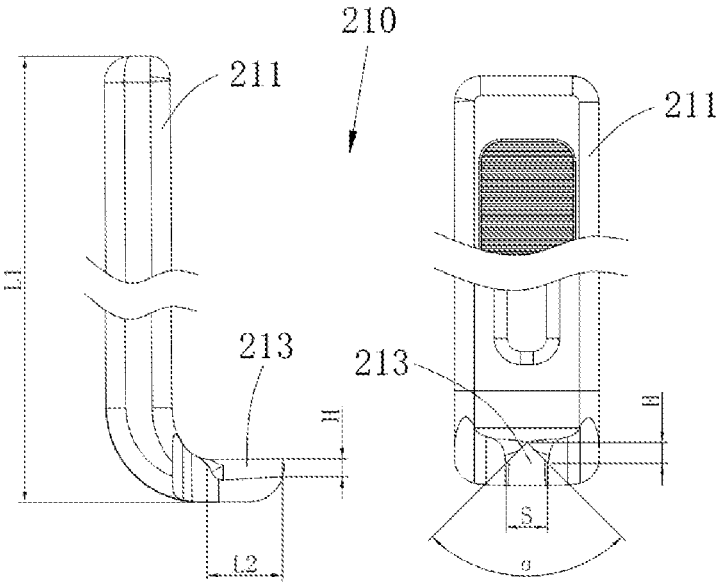
FIG. 5 is a partial schematic view of the storage component disassembly tooling in Embodiment 1 of the present invention.
Figure 6:
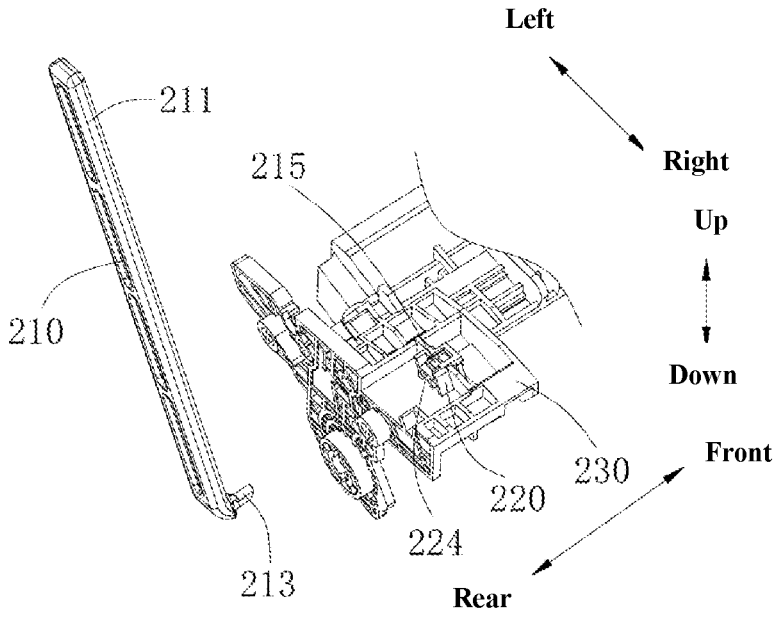
FIG. 6 is a schematic view of the storage component disassembly tooling before a prying portion is inserted into a groove in Embodiment 1 of the present invention.
Figure 7:
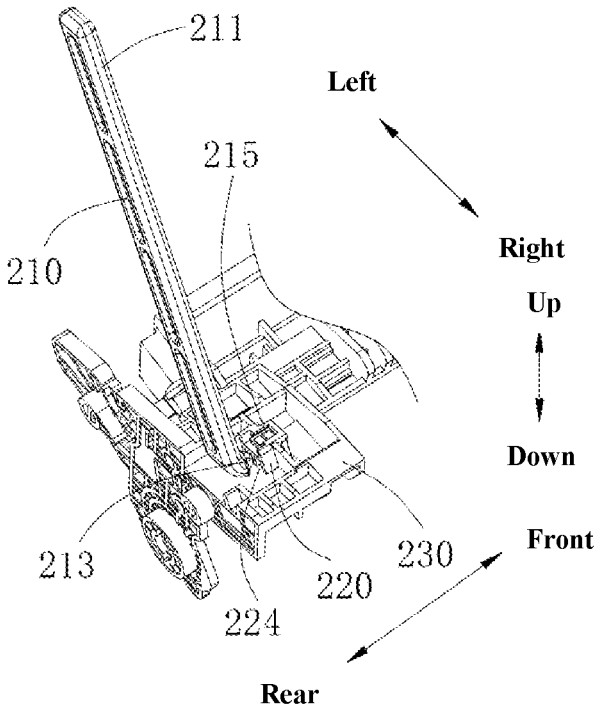
FIG. 7 is a schematic view of the storage component disassembly tooling after the prying portion is inserted into the groove in Embodiment 1 of the present invention.
Figure 8:
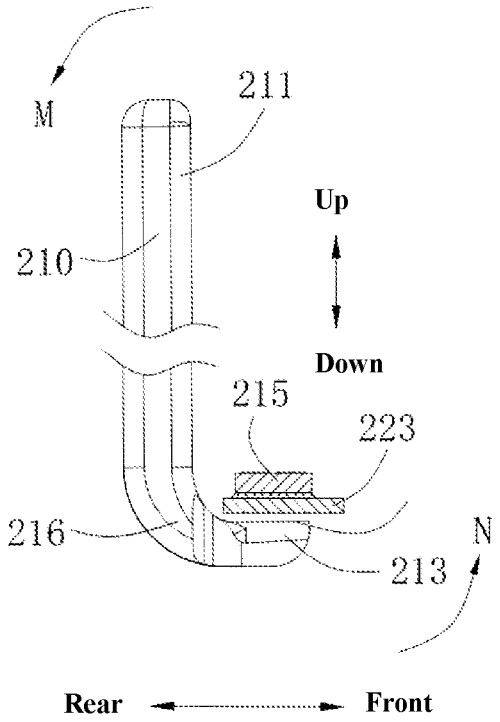
FIG. 8 is a schematic view of the storage component disassembly tooling before disassembling a storage component in Embodiment 1 of the present invention.
Figure 9:
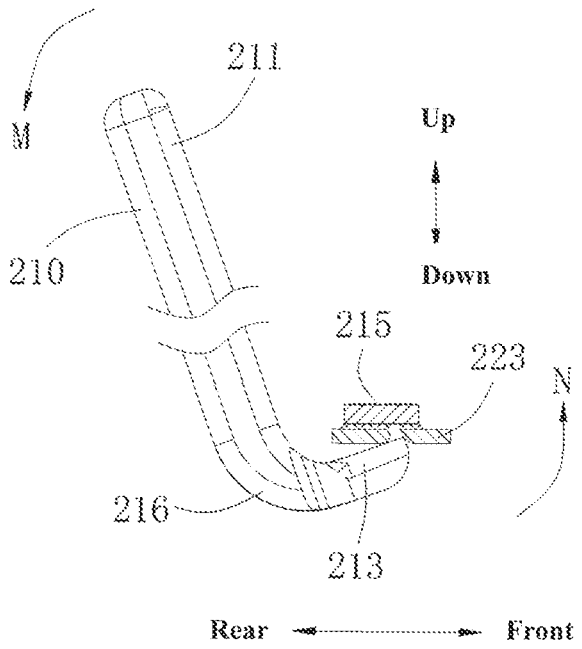
FIG. 9 is a schematic view of the storage component disassembly tooling when disassembling the storage component in Embodiment 1 of the present invention.

In order to make the solution easy to understand, first of all, the process cartridge in the prior art will be briefly introduced. As shown in FIG. 2, a storage component 215 is mounted into a storage component mounting bracket 220 along a direction from rear to front, wherein a direction perpendicular to a thickness of the storage component 215 is an up-down direction, a front surface 215*a* is located on an upper side of a back surface 215*b* in the up-down direction, and a left-right direction is perpendicular to both the front-rear direction and the up-down direction.

Structure of Process Cartridge

Figure 1:
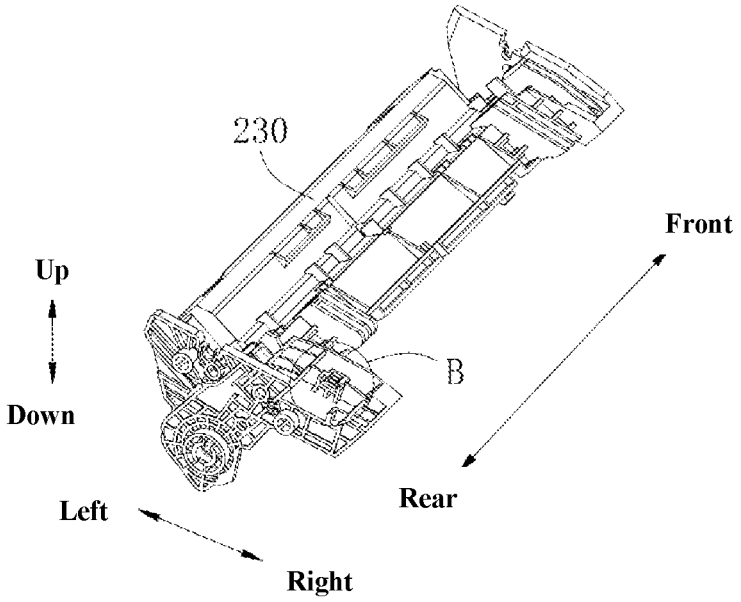
FIG. 1 is a schematic view of a housing in Embodiment 1 of the present invention.

As shown in FIGS. 1-2, it is an existing process cartridge, which is detachably mounted in an electrophotographic imaging device with an electrical contact. It includes a housing 230, a storage component mounting bracket 220, and a storage component 215.

The housing 230 supports a photosensitive drum (not shown) that can form an image.

The storage component mounting bracket 220 is provided on a side of the housing 230 in a longitudinal direction. The storage component mounting bracket 220 includes: an accommodating portion 222 for accommodating the storage component 215; limiting portions 221, wherein a pair of limiting portions 221 are located on an upper side of the storage component 215 and are oppositely disposed on both sides of the storage component 215 in the left-right direction; a supporting portion 223 that is located on a lower side of the storage component 215 and can be used to support the storage component 215; and grooves 224, wherein a pair of grooves 224 are located on a lower side of the supporting portion 223 and are adjacently disposed in the left-right direction. Generally, the storage component mounting bracket 220 is made of ABS or HIPS resin material. It has general mechanical properties, and general material hardness and rigidity. When it is cut or pried with a material with higher hardness and rigidity, the structure can be destroyed.

The storage component 215 can store related parameter information such as a model number and the number of printed pages of the process cartridge. The storage component 215 is mounted in the accommodating portion 222 in a matching manner, and at the same time, is limited by the supporting portion 223 and the limiting portions 221 to prevent the storage component 215 from moving in the up-down direction. The storage component 215 includes a front surface 215*a* and a back surface 215*b* opposite to the front surface 215*a*. The front surface 215*a* is provided with an electrical contact point. The electrical contact point can be in electrical contact with the electrical contact to establish a communication connection with the electrophotographic imaging device. The back surface 215*b* is adhered to the supporting portion 223 by an adhesive such as epoxy resin glue. Under the limitation of the above structure, the storage component 215 is fixed in the storage component mounting bracket 220.

Structure of Storage Component Disassembly Tooling

As shown in FIGS. 3-9, the present invention provides a storage component disassembly tooling 210, which can be used to disassemble the storage component 215 on the process cartridge. Preferably, the storage component disassembly tooling 210 is generally configured to be L-shaped. The material of the storage component disassembly tooling 210 is preferably but not limited to metal. A resin material with high hardness such as POM material, or a mixed material of common resin such as ABS and glass fiber, may also be selected for the storage component disassembly tooling 210.

The storage component disassembly tooling 210 includes a support portion 211. It is preferably a long handle shape, which is convenient for a user to grasp.

The storage component disassembly tooling 210 further includes a prying portion 214. Preferably, the prying portion 214 includes a cutting portion 213, and a cutter edge is provided on the cutting portion 213. The prying portion 214 is disposed at one end of the support portion 211 in the longitudinal direction and extends outward from the support portion 211 in a direction intersecting the longitudinal direction of the support portion 211. The extending direction of the prying portion 214 is approximately the same as the extending direction of the cutting portion 213. The storage component disassembly tooling 210 in this embodiment adopts a design with one prying portion 214. The one prying portion 214 can be inserted into any one of the grooves 224 on the storage component mounting bracket 220. When the storage component disassembly tooling 210 is used to disassemble the storage component 215, on the one hand, the prying portion 214 applies a prying force on one side of the storage component mounting bracket 220 in the left-right direction, and at the same time, the arrangement of the cutting portion 213 can ensure that the prying portion 214 cuts the resin material at the storage component mounting bracket 220 during the prying process. Since there is a process of cutting the resin at the storage component mounting bracket 220 during the prying process, the storage component mounting bracket 220 can be gently pried, which can avoid the occurrence of stress concentration in the storage component mounting bracket 220 and the storage component 215 during the prying process, causing the storage component 215 to collapse and fly. On the other hand, the prying portion 214 applies the prying force on the one side of the storage component mounting bracket 220 in the left-right direction, and the other side of the storage component mounting bracket 220 is not pried up but is still adhered to the storage component mounting bracket 220, because the storage component mounting bracket 220 receives force on only one side in the left-right direction. The storage component 215 is pried from a single side of the storage component 215 by the prying portion 214. Therefore, the prying process described above is smooth. Further, in order to ensure that the prying portion 214 can be inserted into the groove 224 and make the cutting portion 213 have sufficient cutting performance and mechanical strength, in the extending direction of the cutting portion 213, the cutting portion 213 has a length L2, preferably, $L2 \geq 1.5$ mm. In addition, the cutting portion 213 has a height H, preferably, $1\text{ mm} \leq H \leq 3.5\text{ mm}$, and the cutting portion 213 has a width S, preferably, $1\text{ mm} \leq S \leq 3\text{ mm}$. Further, a length L1 of the support portion 211 is greater than the length L2 of the cutting portion 213. Therefore, the longer the arm of force of the support portion 211 is, the smaller the required torque is, which makes it more labor-saving when the storage component disassembly tooling 210 is used to disassemble the storage component 215. Further, preferably, $10L2 \leq L1 \leq 30L2$. When $L1 < 10L2$, the support portion 211 is too short to be grasped. When $L1 \geq 30L2$, the support portion 211 is too long, the material waste is large, and the production cost is high. Therefore, in consideration of graspability and economy, the storage component disassembly tooling 210 of this embodiment is preferably the solution of $10L2 \leq L1 \leq 30L2$. The cutting portion 213 includes a first side cutter edge 213*a*, a second side cutter edge 213*b*, and a cutter tip 213*c* formed by the first side cutter edge 213*a* and the second side cutter edge 213*b* intersecting at an angle $\alpha$. When viewed along the extending direction of the cutting portion 213, the cutting portion 213 is generally configured to be V-shaped. Further, $30° \leq \alpha \leq 150°$. When $\alpha < 30°$, the cutting portion 213 has insufficient mechanical strength and is easily damaged. When $\alpha \geq 150°$, the cutting performance of the cutting portion 213 is insufficient, and it is difficult to disassemble the storage component 215. Therefore, $30° \geq \alpha \geq 150°$ is preferable, and at this time, the cutting portion 213 has both mechanical strength and cutting performance. Optionally, the prying portion 214 may not be provided with a cutting portion 213. For example, the prying portion 214 may also be provided as a structure having an arc portion, wave point portion or flat portion in (a), (b) and (c) of FIG. 4. In (a) of FIG. 4, the prying portion 214 has an outer surface 214*a*, and the outer surface is arc-like. Through the arc-like outer surface 214*a*, the storage component 215 mounted in the storage component mounting bracket 220 can also be pried out. In (b) of FIG. 4, the prying portion 214 has an outer surface 214*b*, and the outer surface has a wave point. Through the wave point on the outer surface 214*b*, the storage component 215 mounted in the storage component mounting bracket 220 can also be pried out. In (c) of FIG. 4, the prying portion 214 has an outer surface 214*c* configured as a flat surface. Through the outer surface 214*c* configured as the flat surface, the storage component 215 mounted in the storage component mounting bracket 220 can also be pried out.

The storage component disassembly tooling 210 further includes a fulcrum portion 216, which is approximately configured in an arc shape. The fulcrum portion 216 connects the support portion 211 and the prying portion 214. When the storage component disassembly tooling 210 is used to disassemble the storage component 215, both the support portion 211 and the prying portion 214 can rotate around the fulcrum portion 216. The fulcrum portion 216 is configured as a positioning portion for positioning the storage component disassembly tooling 210. When the cutting portion 216 of the storage component disassembly tooling 210 starts to apply force to the storage component mounting bracket 220, the fulcrum portion 216 serves as a positioning portion to position the storage component disassembly tooling 210 relative to the storage component mounting bracket 220 so as to pry up the storage component mounting bracket.

Further, the storage component disassembly tooling 210 further includes a plurality of hole portions 217 arranged and extending along the longitudinal direction of the support portion 211, and the hole portion 217 is a through hole formed on the support portion 211. The plurality of hole portions 217 are provided on the support portion, so that the material consumption is reduced, and the production cost of the storage component disassembly tooling is reduced. Moreover, since the weight of the storage component disassembly tooling is reduced, the transportation cost of the storage component disassembly tooling is also reduced.

Further, the storage component disassembly tooling 210 further includes a polishing portion 212, which is provided at the other end of the support portion 211 in the longitudinal direction. The polishing portion 212 is a plurality of protrusions formed on the support portion 211 and can be used to clean and polish the disassembled storage component 215 adhered with epoxy resin glue.

Embodiment 2

Figure 10:
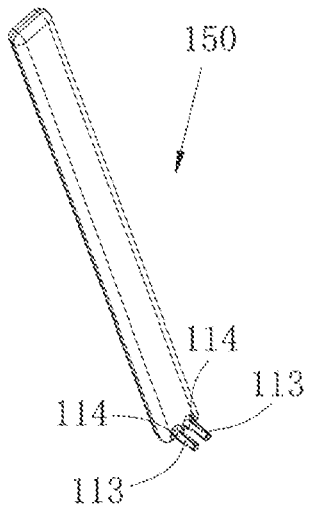
FIG. 10 is a schematic view of a storage component disassembly tooling in Embodiment 2 of the present invention.
Figure 11:
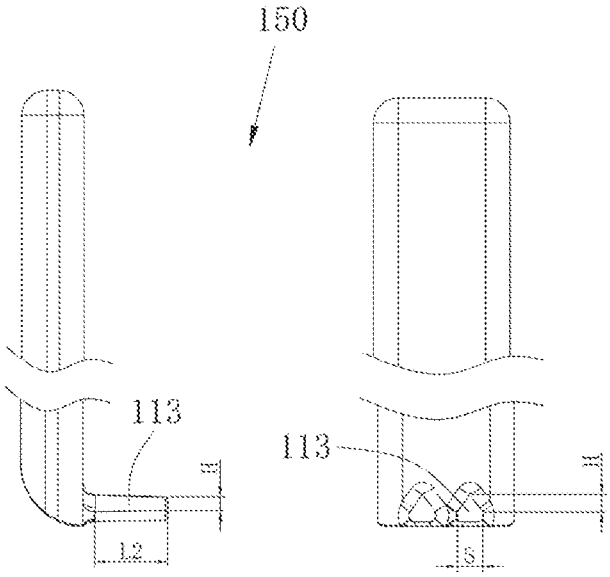
FIG. 11 is a partial schematic view of the storage component disassembly tooling in Embodiment 2 of the present invention.
Figure 12:
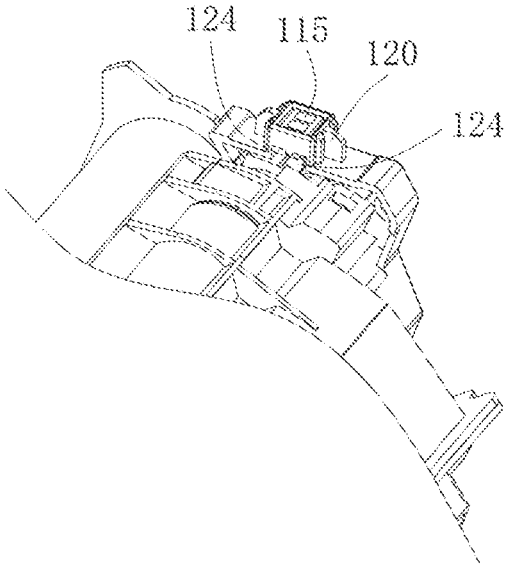
FIG. 12 is a partial schematic view of a housing in Embodiment 2 of the present invention.

As shown in FIGS. 10-12, Embodiment 2 of the present invention will be described in detail below. A process cartridge of Embodiment 2 has the same basic structure as that of Embodiment 1 described above, and it will not be repeated here. The difference is that the storage component disassembly tooling 150 of this embodiment has one pair of prying portions 114. The one pair of prying portions 114 are disposed at a certain distance along the thickness direction of the cutting portion 113. The one pair of prying portions 114 can be correspondingly inserted into one pair of grooves 124 of the storage component mounting bracket 120. When the storage component disassembly tooling 150 is used to disassemble the storage component 115, the one pair of prying portions 114 can cut into or squeeze the storage component mounting bracket 220 at the same time. Each prying portion 114 bears less force, so the mechanical strength requirements of the prying portions 114 are reduced. At the same time, because each prying portion 114 bears less force, a part of the storage component mounting bracket 220 being squeezed bears less force, so that the part of the storage component 115 bears less force, reducing the probability of damage to the storage component 115. Further, in order to ensure that the pry portions 114 can be inserted into the one pair of grooves 124 and the cutting portion 113 has sufficient cutting performance and mechanical strength, in the extending direction of the cutting portion 113, the cutting portion 113 has a length L2, preferably, L2≥1.5 mm. In addition, the cutting portion 113 has a height H, preferably, 1 mm≤H≤2.5 mm, and the cutting portion 113 has a width S, preferably, 1 mm≤S≤2.5 mm.

Embodiment 3

Figure 13:
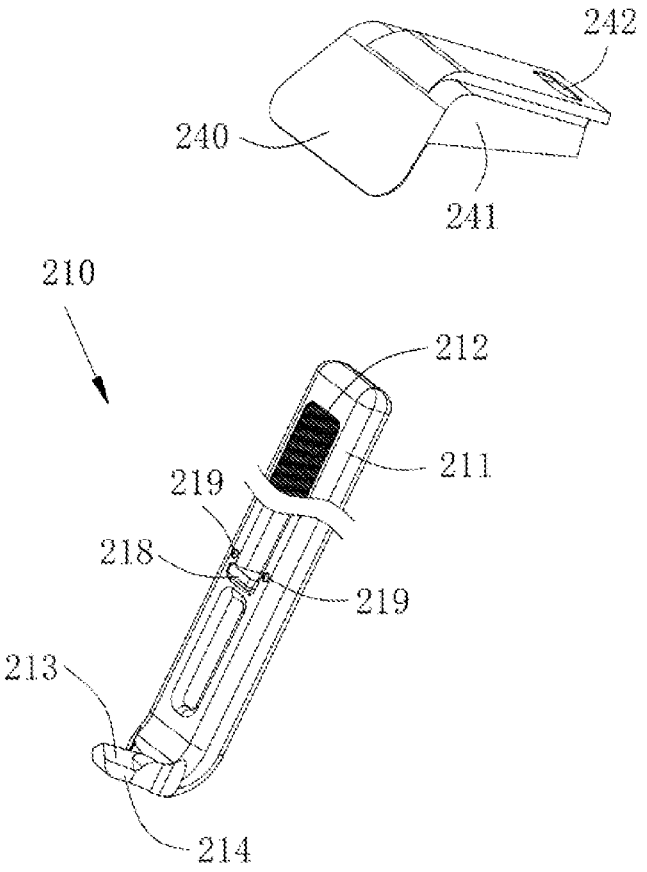
FIG. 13 is a schematic view of a cover portion not mounted onto a support portion in Embodiment 3 of the present invention.
Figure 14:
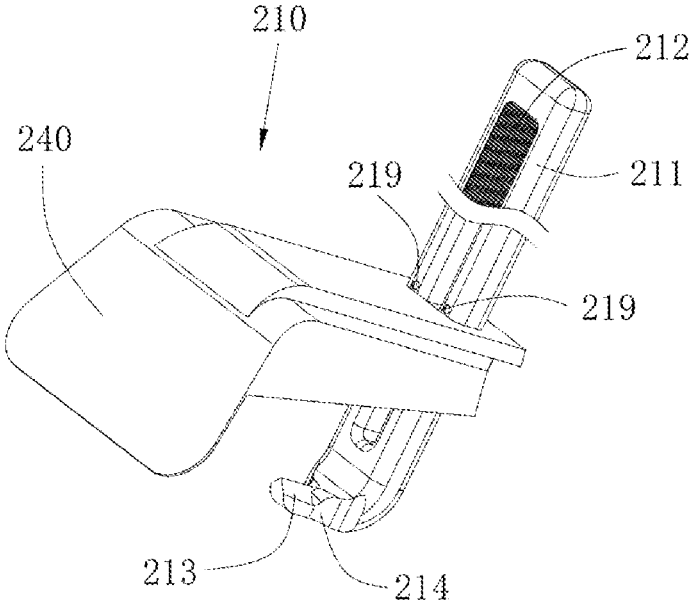
FIG. 14 is a schematic view of the cover portion mounted onto the support portion in Embodiment 3 of the present invention.

As shown in FIGS. 2 and 13-14, next, embodiment 3 of the present invention will be described in detail. A process cartridge of Embodiment 3 has the same basic structure as those of Embodiments 1 and 2, and it will not be repeated here. The difference is that the storage component disassembly tooling 210 in Embodiment 3 is further provided with a cover portion 240, which is mounted at one end of the support portion 211 in the longitudinal direction close to the prying portion 214. When a user disassembles the storage component 215 and the storage component 215 collapses and flies due to excessive force, the cover portion 240 can be used to prevent the storage component 215 from collapsing and flying, avoiding the situation that the collapsed storage component 215 flies off randomly, causing it to be difficult to find. The cover portion 240 includes a cover portion main body 241 and a mounting opening 242 formed on the cover portion main body 241 and configured as a through hole. The cover portion 240 can be mounted on the support portion 211 through the mounting opening 242. Further, the support portion 211 is also provided with a blocking portion 218 protruding outward from the support portion 211 in a direction intersecting the longitudinal direction of the support portion 211. The blocking portion 218 may limit the cover portion 240 from moving in the longitudinal direction of the support portion 211 toward the prying portion 214 close to one end of the support portion 211 in the longitudinal direction. The support portion 211 is also provided with a pair of protrusions 219. In the longitudinal direction of the support portion 211, the protrusions 219 are farther away from the prying portion 214 than the blocking portion 218, and the protruding direction of the protrusions 219 on the support portion 211 is the same as that of the blocking portion 218 and they are disposed adjacent to the blocking portion 218. The protrusions 219 can limit the cover portion 240 from moving in the longitudinal direction of the support portion 211 toward the polishing portion 212 close to the other end of the support portion 211 in the longitudinal direction. The position of the cover portion 240 on the support portion 211 can be limited by providing the blocking portion 218 and the protrusions 219 on the support portion 211 to position the cover portion 240. Optionally, the support portion 211 may be not provided with the blocking portion 218 and the protrusions 219, and the cover portion 240 can be mounted on the support portion 211 by means of interference fit. Further, the cover portion 240 is made of a transparent material, through which the disassembly state of the storage component 215 can be observed in real time.

Embodiment 4

Next, Embodiment 4 of the present invention will be described in detail. A process cartridge in this embodiment has a structure different from those of the above embodiments. First of all, the structure of the process cartridge in this embodiment will be briefly introduced below.

Structure of Process Cartridge

Figure 15:
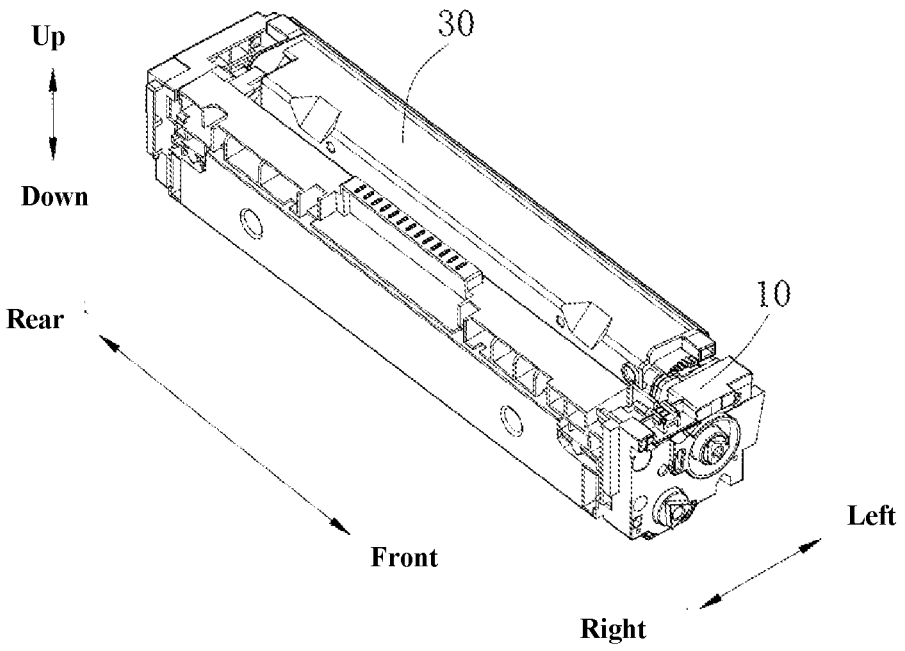
FIG. 15 is a schematic view of a process cartridge in Embodiment 4 of the present invention.
Figure 16:
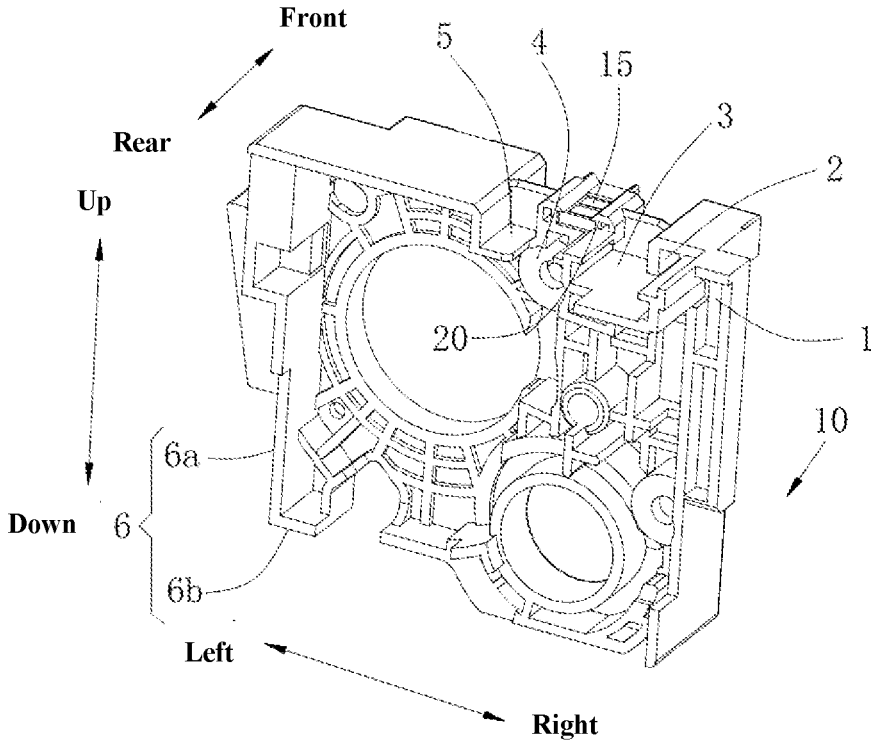
FIG. 16 is a schematic view of a protective cover from a certain angle in Embodiment 4 of the present invention.
Figure 17:
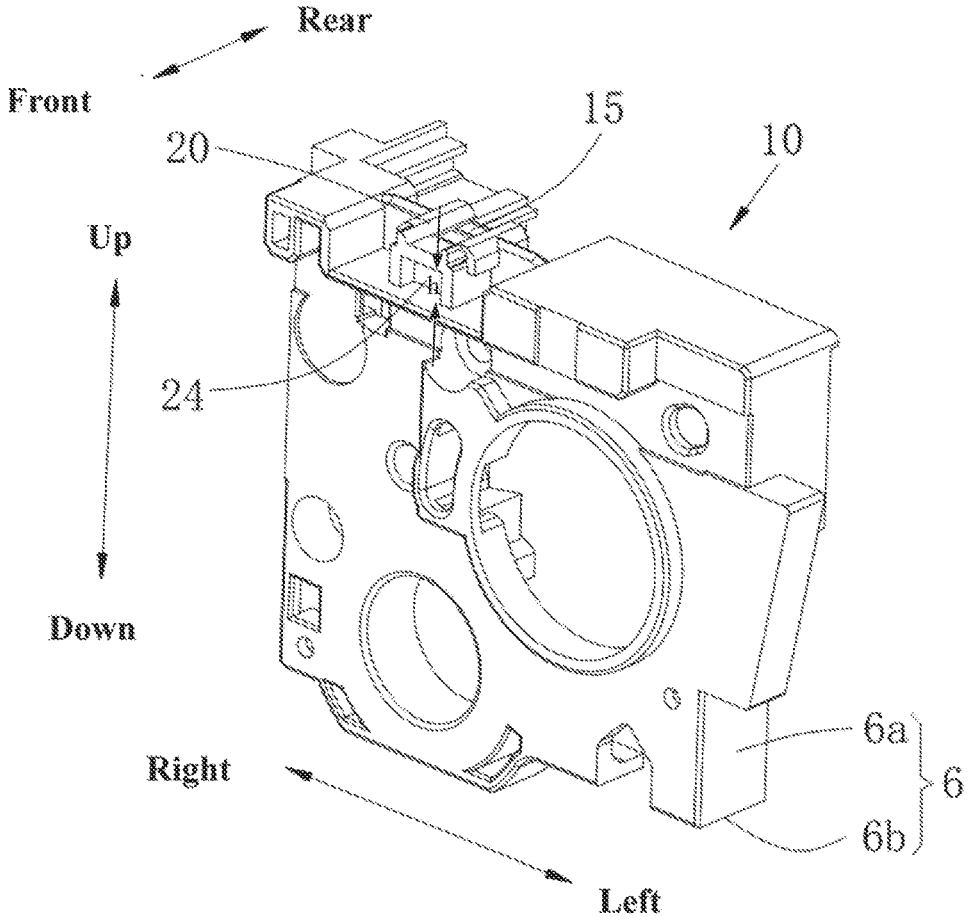
FIG. 17 is a schematic view of the protective cover from another angle in Embodiment 4 of the present invention.
Figure 18:
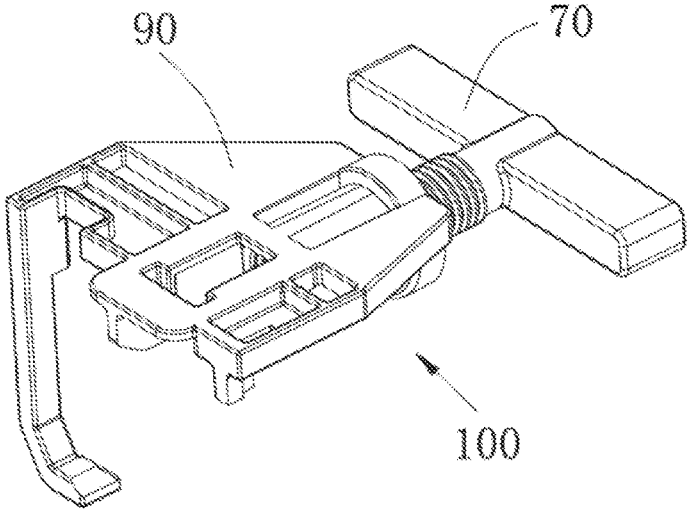
FIG. 18 is a schematic view of a storage component disassembly tooling in Embodiment 4 of the present invention.
Figure 19:
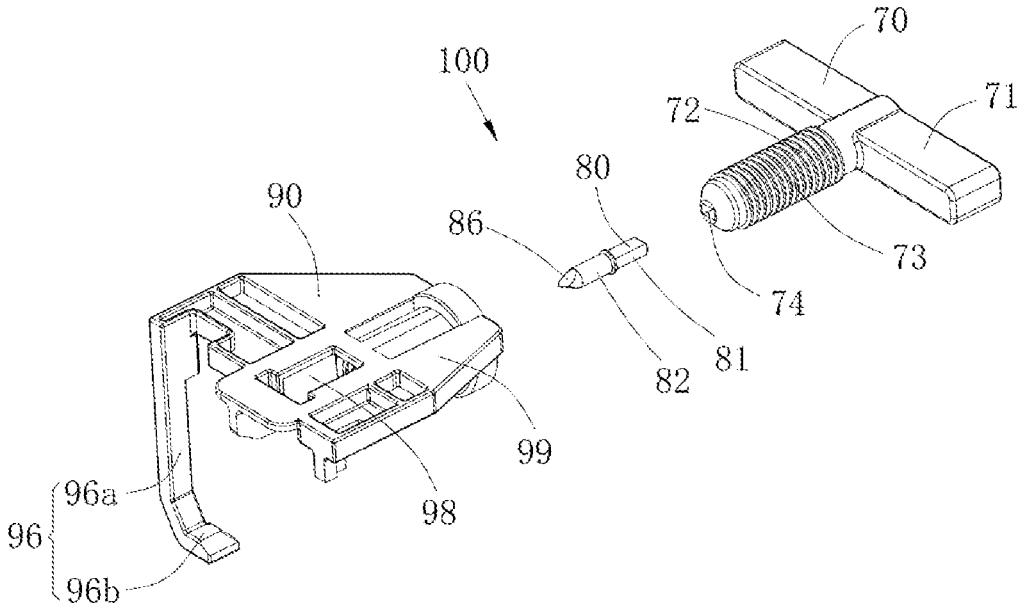
FIG. 19 is an exploded schematic view of the storage component disassembly tooling from a certain angle in Embodiment 4 of the present invention.

As shown in FIGS. 15-17, an existing process cartridge includes: a housing 30 that can contain a developer; and a protective cover 10 disposed on one side of the housing 30 in a longitudinal direction. The protective cover 10 includes a first slot 1, a second slot 2, a third slot 3, a fourth slot 4, a fifth slot 5, and a bonded portion 6 that are disposed at intervals in the left-right direction. The bonded portion 6 includes a first bonded portion 6*a* located at a left end of the protective cover 10 and a second bonded portion 6*b* located at a lower end of the protective cover 10. In the left-right direction, the first slot 1, the second slot 2, and the third slot 3 are located on a right side of the storage component 15, the fifth slot 5 and the bonded portion 6 are located on a left side of the storage component 15, and the fourth slot 4 is located between the third slot 3 and the fifth slot 5. In the up-down direction, the first slot 1, the second slot 2, the third slot 3, the fourth slot 4, and the fifth slot 5 are all located on an upper side of the protective cover 10.

Structure of Storage Component Disassembly Tooling

As shown in FIGS. 16 to 25, this embodiment provides a new storage component disassembly tooling 100 according to the structure of the process cartridge described above, and it can be used to disassemble the storage component 15 on the process cartridge.

The storage component disassembly tooling 100 includes a support portion 70. The support portion 70 has a handle 71 and a drilling portion supporting portion 72 extending outward from an approximately central position of the handle 71 in the longitudinal direction. The handle 71 and the drilling portion supporting portion 72 are approximately T-shaped. An external thread 73 is formed on an outer surface of the drilling portion supporting portion 72, and a connecting hole 74 is further provided at an extending end of the drilling portion supporting portion 72. The connecting hole 74 is configured to have a non-circular outer shape.

The storage component disassembly tooling 100 further includes a drilling portion 80. One end of the drilling portion 80 in the longitudinal direction is provided with a connecting shaft 81, and the connecting shaft 81 is in interference fit with the connecting hole 74. Further, the connecting shaft 81 is configured to have a non-circular outer shape and can be in fit with the connecting hole 74 that is also configured to have the non-circular outer shape. By adopting the connecting shaft 81 configured to have the non-circular outer shape, the anti-torsion ability is improved, and the drilling portion 80 is prevented from slipping during rotation, thereby improving the connection stability of the drilling portion 80. The other end of the drilling portion 80 in the longitudinal direction is further provided with a cutting portion 86. The cutting portion 86 includes a cutter edge portion, and the cutter edge portion includes a first side cutter edge 83, a second side cutter edge 84, and a cutter edge 85 formed by the first side cutter edge 83 and the second side cutter edge 84 intersecting at an angle. The drilling portion 80 is drilled into the storage component mounting bracket 20 through the contact between the cutter edge portion and the storage component mounting bracket 20. Further, the angle formed by the first side cutter edge 83 and the second side cutter edge 84 is an acute angle. This configuration allows the user to cut into the storage component mounting bracket 20 with a small force, saving time and labor. Optionally, it may also be an obtuse angle. Further, the drilling portion 80 also includes a cylindrical portion 82 connected between the connecting shaft 81 and the cutting portion 86. A smooth transition is adopted between the cylindrical portion 82 and the cutter edge 85. This configuration is beneficial for the cylindrical portion 82 to smoothly enter the storage component mounting bracket 20 after the cutter edge 85 is completely cut into the storage component mounting bracket 20. The groove 24 of the storage component mounting bracket 20 has a height h in the up-down direction. A diameter of the cylindrical portion 82 is greater than the height h of the groove 24, so that when the cylindrical portion 82 enters the storage component mounting bracket 20, the cylindrical portion 82 can press the storage component mounting bracket 20 up and down to deform it. Preferably, in order to save the cost and ensure the drilling effect of the drilling portion 80, the drilling portion 80 is made of metal material, and the support portion 70 is made of plastic material. Optionally, the cylindrical portion 82 on the drilling portion 80 can also be configured in other shapes, such as elliptical, triangular, polygonal, etc., as long as its external structure can squeeze the storage component mounting bracket 20 to deform it, thereby making the storage component 15 be pushed out from the storage component mounting bracket 20. The above cylindrical portion of the drilling portion 80 and its modification are referred to as a squeezing portion of the drilling portion 80. When projected along the drilling direction of the drilling portion 80, a trajectory is described by an outer shape of the squeezing portion during the rotation thereof. Preferably, a height h of the maximum dimension of the contour described by the trajectory is greater than the height h of the groove 24. Optionally, the height h of the maximum dimension of the contour described by the trajectory may also be less than or equal to the height h of the groove 24. At this time, the highest point of the contour described by the trajectory is higher than the supporting portion 23 of the storage component mounting bracket 20 supporting the storage component 15, and the technical effect of pushing out the storage component 15 can also be achieved. In summary, the drilling portion 80 drills into the storage component mounting bracket 20 in a manner of destroying at least a part of the storage component mounting bracket 20, and the squeezing portion of the drilling portion 80 can squeeze a part of the storage component mounting bracket 20 to deform it so as to push out the storage component 15.

Further, the storage component disassembly tooling 100 further includes a positioning portion 90. The positioning portion 90 includes a positioning portion main body 99, which is generally configured as a flat plate, and an internal thread 97 provided on the positioning portion main body 99. Through the engagement of the internal thread 97 and the external thread 73, the support portion 70 can move relative to the positioning portion 90, and the drilling portion 80 connected to the support portion 70 can move relative to the positioning portion 90 as the amount of engagement between the internal thread 97 and the external thread 73 changes. Further, the positioning portion 90 further includes a first protruding portion 91, a second protruding portion 92, a third protruding portion 93, a fourth protruding portion 94, a fifth protruding portion 95 and a bonding portion 96 that extend outward from the positioning portion main body 99 and are disposed at intervals. The bonding portion 96 includes a first bonding portion 96*a* extending outward from the positioning portion main body 99 and a second bonding portion 96*b* located at a free end of the first bonding portion 96*a*. A plane where the first bonding portion 96*a* is located is perpendicular to a plane where the second bonding portion 96*b* is located. The first protruding portion 91, the second protruding portion 92, the third protruding portion 93, the fourth protruding portion 94, and the fifth protruding portion 95 can be correspondingly inserted into the first slot 1, the second slot 2, the third slot 3, the fourth slot 4, and the fifth slot 5 on the protective cover 10, respectively. The first bonding portion 96*a* can abut against the first bonded portion 6*a* of the protective cover 10, and the second bonding portion 96*b* can abut against the second bonded portion 6*b* of the protective cover 10. When the storage component 15 is disassembled, force is applied so that the support portion 70 and the drilling portion 80 gradually approach the protective cover 10. At the same time, it will also generate a reaction force away from the protective cover 10. By providing the first protruding portion 91, the second protruding portion 92, the third protruding portion 93, the fourth protruding portion 94, the fifth protruding portion 95, and the bonding portion 96 on the positioning portion 90, the first protruding portion 91, the second protruding portion 92, the third protruding portion 93, the fourth protruding portion 94, the fifth protruding portion 95, and the bonding portion 96 abut against the first slot 1, the second slot 2, the third slot 3, the fourth slot 4, the fifth slot 5, and the bonded portion 6 on the protective cover 10, respectively, and the positioning portion 90 is limited in the left-right, up-down and front-rear directions. Thus, when the storage component disassembly tooling 100 is operated, the storage component disassembly tooling 100 will not be displaced, which improves the disassembly precision and disassembly stability and is safer. Optionally, the number of protruding portions or bonding portions on the positioning portion 90 is not limited to 6 in this embodiment. It may also be 1 to 5 or more than 6. Moreover, the positioning structure of the positioning portion 90 is not limited to the above structure, and can be specifically set according to the structure of the process cartridge. Further, the positioning portion further includes an opening 98. The opening 98 is a through hole formed on the positioning portion main body 99. After the storage component disassembly tooling 100 is mounted on the process cartridge, the storage component 15 is exposed through the opening 98. When the storage component 15 is disassembled, the opening 98 exposes the storage component 15 when the positioning portion 90 is mounted on the process cartridge. The disassembly state of the storage component 15 can be easily observed through the opening 98, and the storage component 15 can be taken out through the opening 98 after the disassembly is completed. Optionally, the opening 98 may not be provided on the positioning portion 90. The positioning portion 90 can be made of a transparent material, and the disassembly state of the storage component 15 can also be observed in real time.

Process of assembling and mounting storage component disassembly tooling onto process cartridge As shown in FIGS. 16 to 19, the assembly process of the storage component disassembly tooling 100 is as follows:

Step 1: Mount the connecting shaft 81 of the drilling portion 80 onto the connecting hole 74 of the support portion 70 correspondingly.

Step 2: Then, mount the external thread 73 of the support portion 70 onto the internal thread 97 of the positioning portion 90.

However, the above assembly steps of the storage component disassembly tooling 100 are not limited. It is also possible that the operation of step 2 is first performed, and then the operation of step 1 is performed. Both of the two different assembly sequences can correctly assemble the storage component disassembly tooling 100. Optionally, the drilling portion 80 and the support portion 70 may also be manufactured in an integrated manner, thereby eliminating the need to perform the first step. In the process of mounting the support portion 70 to the positioning portion 90, the engagement amount of the external thread 73 and the internal thread 97 should not be too large, so as to avoid interference between the drilling portion 80 and the protective cover 10 during the process of mounting the storage component disassembly tooling 100 onto the process cartridge, causing the storage component disassembly tooling 100 to fail to be mounted normally.

Figure 20:
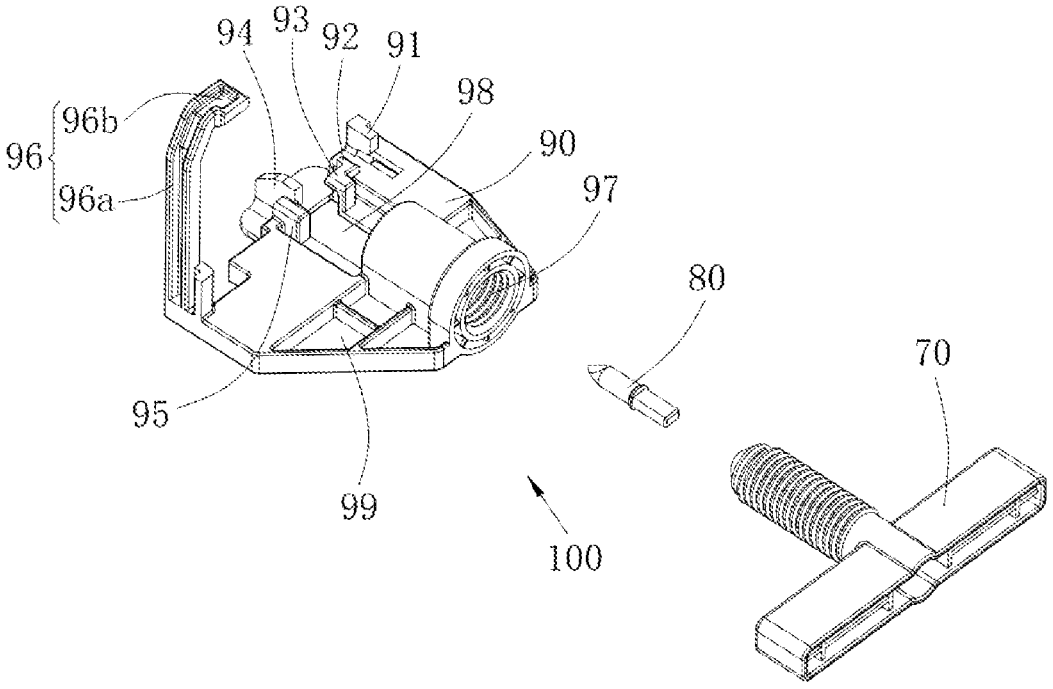
FIG. 20 is an exploded schematic view of the storage component disassembly tooling from another angle in Embodiment 4 of the present invention.
Figure 21:
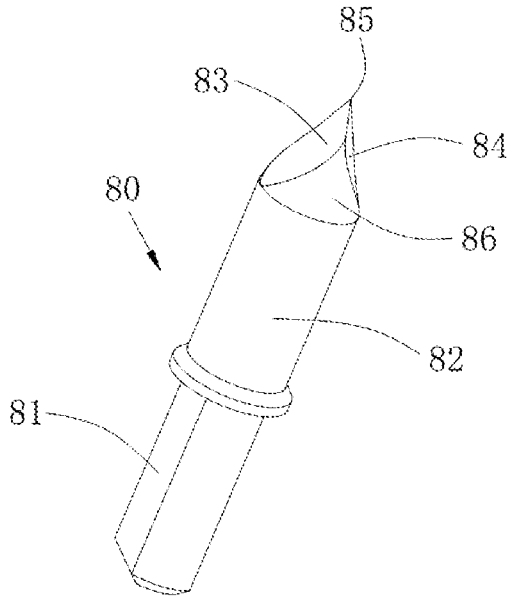
FIG. 21 is a schematic view of a drilling portion in Embodiment 4 of the present invention.
Figure 22:
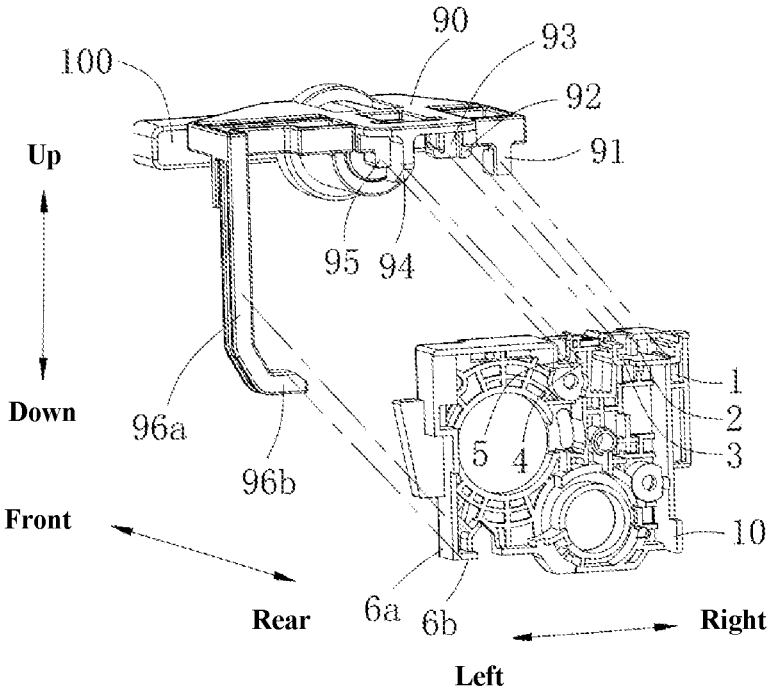
FIG. 22 is a schematic view of an installation relationship of a positioning portion and the protective cover in Embodiment 4 of the present invention.
Figure 23:
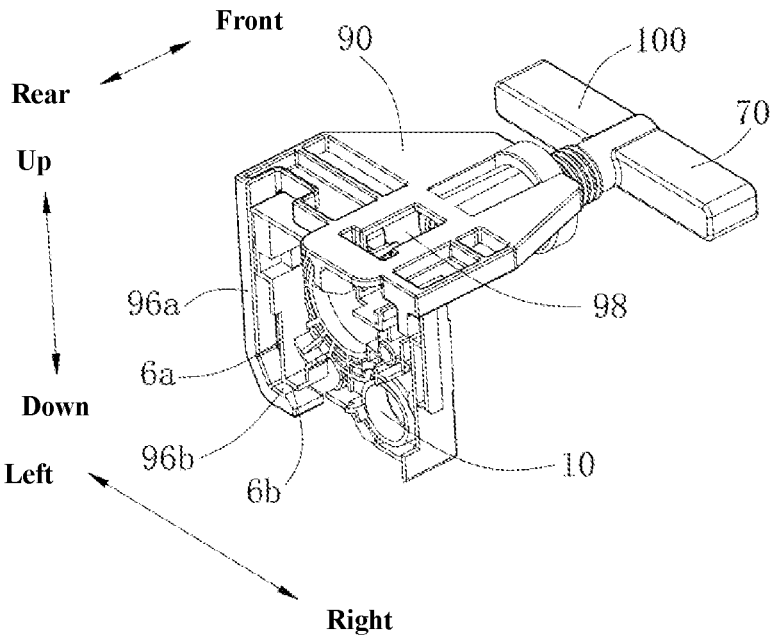
FIG. 23 is a schematic view of the storage component disassembly tooling mounted onto the protective cover from a certain angle in Embodiment 4 of the present invention.
Figure 24:
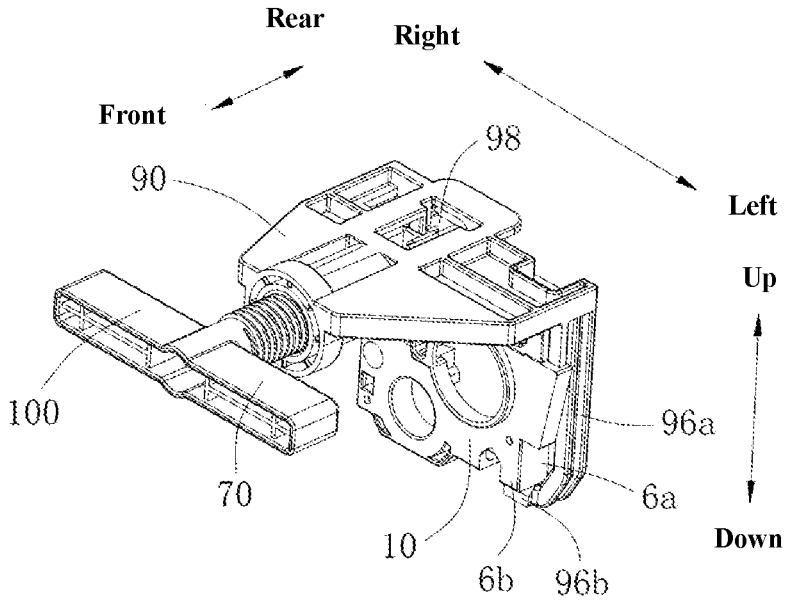
FIG. 24 is a schematic view of the storage component disassembly tooling mounted onto the protective cover from another angle in Embodiment 4 of the present invention.
Figure 25:
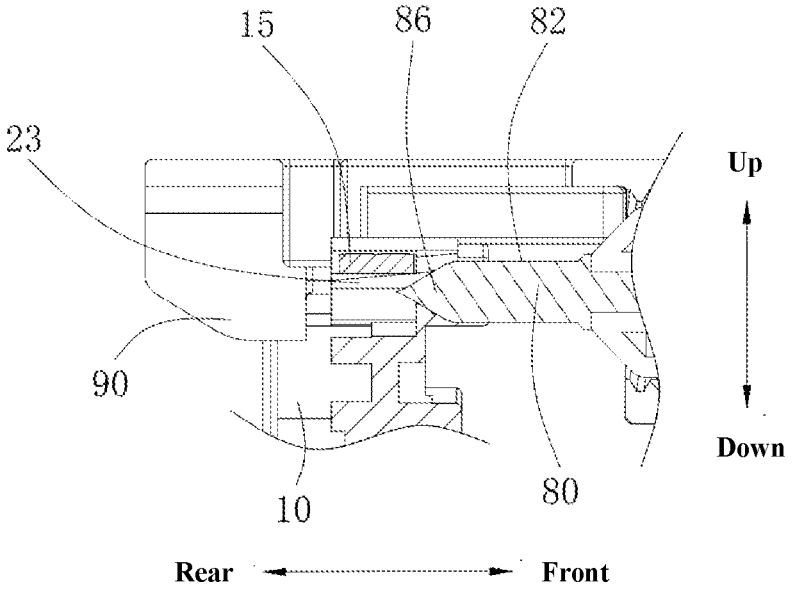
FIG. 25 is a schematic cross-sectional view of a storage component disassembly tooling when disassembling a storage component in Embodiment 4 of the present invention.
Figure 26:
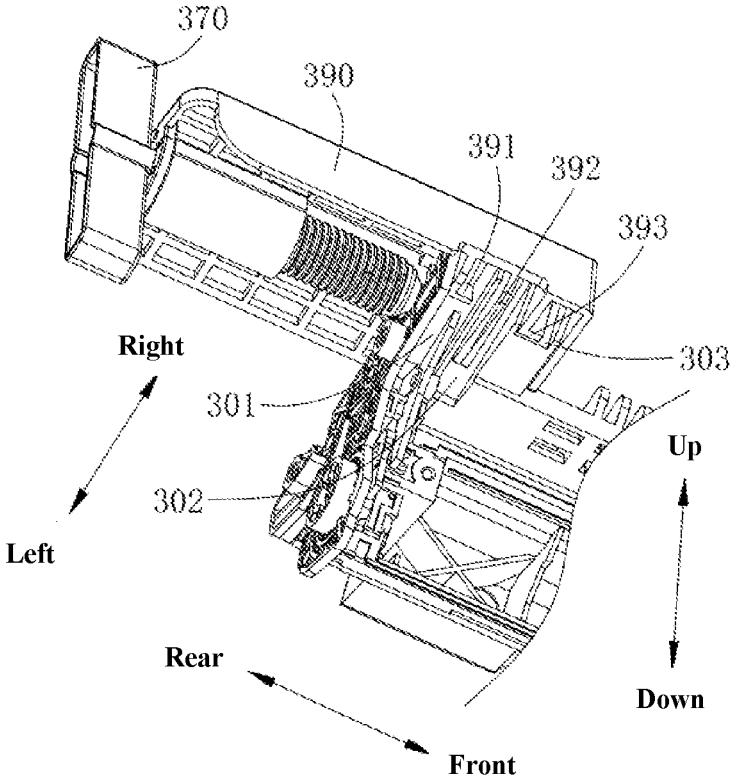
FIG. 26 is a schematic view of a storage component disassembly tooling not mounted onto a housing in Embodiment 5 of the present invention.
Figure 27:
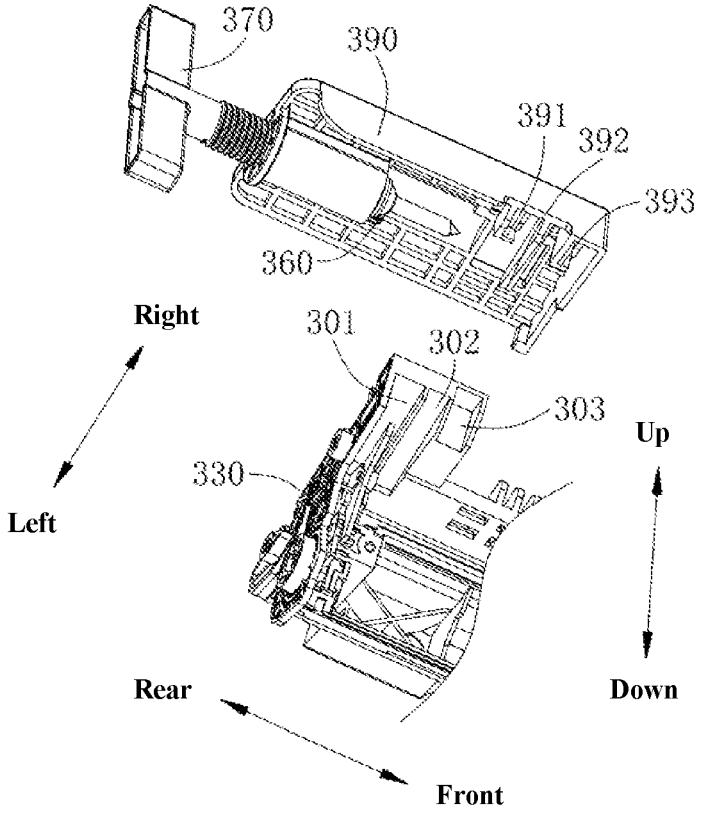
FIG. 27 is a schematic view of the storage component disassembly tooling mounted onto the housing in Embodiment 5 of the present invention.
Figure 28:
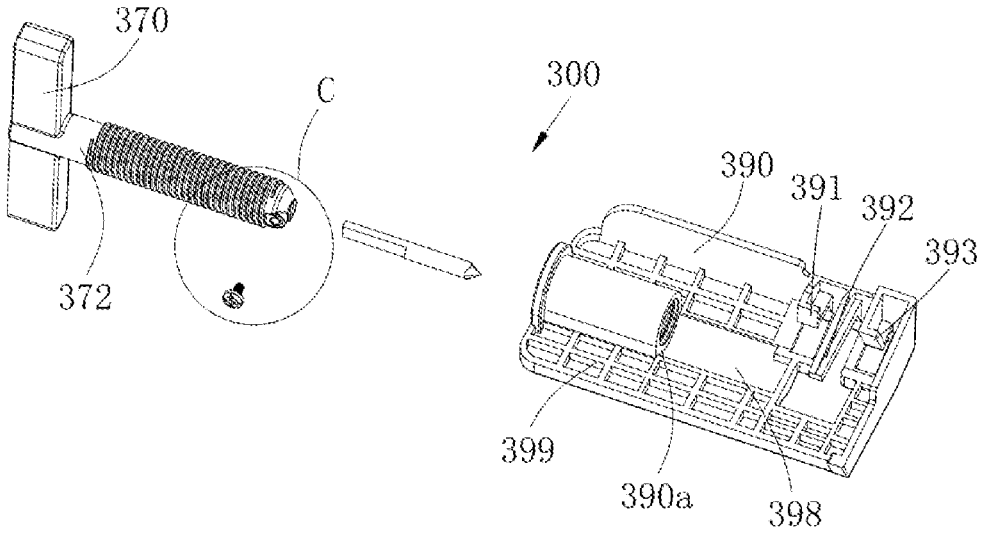
FIG. 28 is an exploded schematic view of the storage component disassembly tooling in Embodiment 5 of the present invention.
Figure 29:
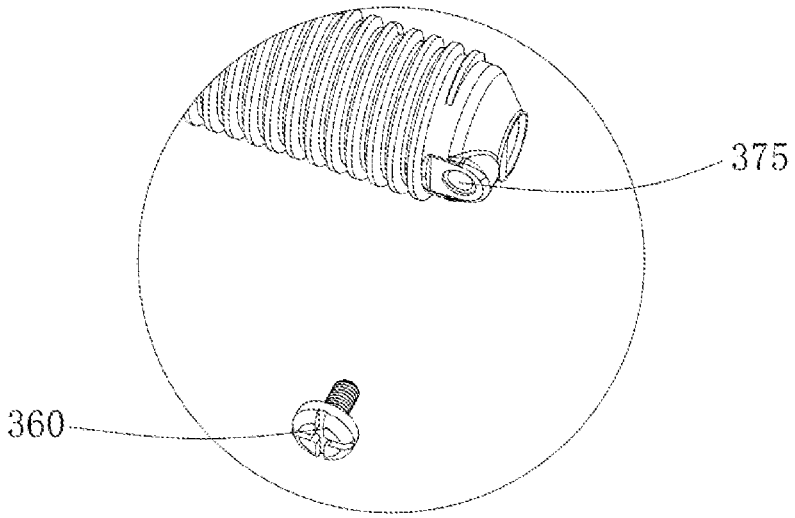
FIG. 29 is a partially enlarged schematic view of a portion in circle C in FIG. 28, showing a limiting portion before it is mounted into a hole portion in Embodiment 5 of the present invention.
Figure 30:
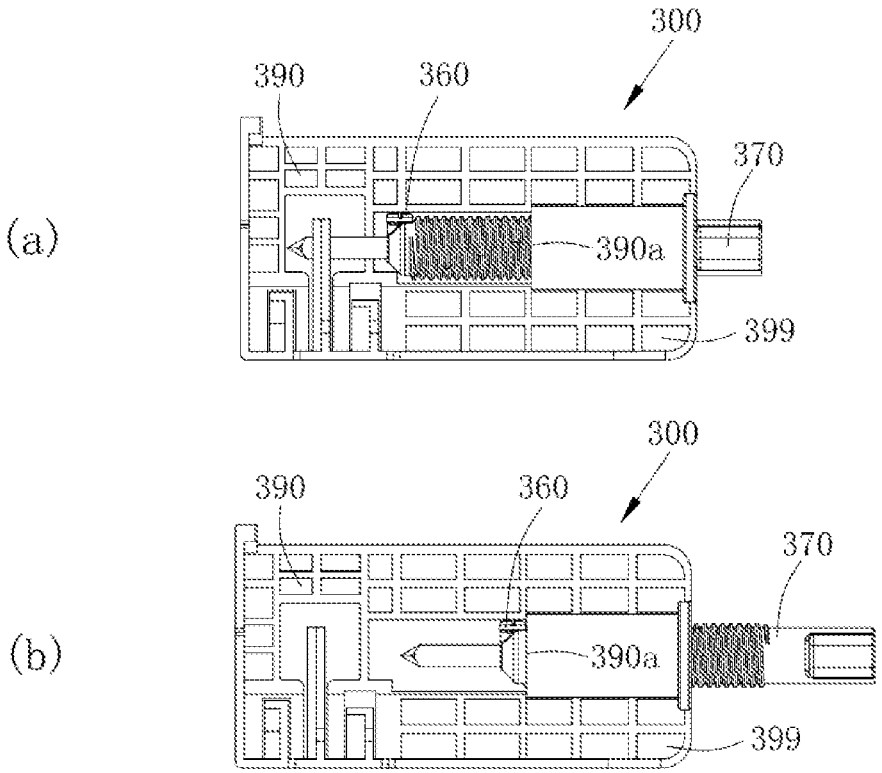
FIG. 30 is a schematic view of a screw position during movement of a support portion in Embodiment 5 of the present invention.

As shown in FIGS. 16 and 20, the process of mounting the storage component disassembly tooling 100 onto the process cartridge is as follows:

Firstly, the support portion 70 of the assembled storage component disassembly tooling 100 is held. Secondly, the first protruding portion 91, the second protruding portion 92, the third protruding portion 93, the fourth protruding portion 94, and the fifth protruding portion 95 of the positioning portion 90 are correspondingly inserted into the first slot 1, the second slot 2, the third slot 3, the fourth slot 4, and the fifth slot 5 of the protective cover 10, respectively, and the bonding portion 96 is correspondingly mounted onto the bonded portion 6. So far, the storage component disassembly tooling 100 has been correctly mounted onto the process cartridge.

As a preferred embodiment, the drilling portion 80 is drilled into the storage component mounting bracket 20 by means of cutting while rotating, so that the drilling portion 80 can be easily and quickly drilled into the storage component mounting bracket 20. Optionally, the drilling portion 80 may also be configured to be drilled without rotation. For example, a screw structure can be provided on the drilling portion supporting portion connected to the drilling portion 80, and another screw that matches the screw structure can be provided at the same time. A handle is connected to the screw, and the handle is rotated to rotate the screw. Through the rotation of the screw, the drilled portion 80 can be driven to be drilled into the storage component mounting bracket 20. In addition, it is also possible that a rack structure is provided on the drilling portion supporting portion of the drilling portion 80, and another screw or gear that matches the rack structure is provided at the same time. By rotating the screw or gear, the drilling portion 80 can be driven to be drilled into the storage component mounting bracket 20 in a non-rotating posture.

Embodiment 5

Embodiment 5 of the present invention will be specifically described below. A process cartridge of this embodiment has the same structure as that of Embodiment 1. The structure of the process cartridge that has been described will not be repeated here. As shown in FIGS. 26-30, the process cartridge further include slot portions 301, 302, and 303, and the slot portions 301, 302, and 303 are adjacently disposed on a rear side of the housing 330 in the front-rear direction.

Structure of Storage Component Disassembly Tooling

The storage component disassembly tooling 300 of this embodiment has generally the same basic structure as that of Embodiment 4 described above. The difference is that parts of the positioning portion 390 and the support portion 370 of the storage component disassembly tooling 300 of this embodiment are different in structure. Specifically, the positioning portion 390 of the storage component disassembly tooling 300 of this embodiment includes protruding portions 391, 392, and 393, wherein the protruding portions 391, 392, and 393 can be correspondingly inserted into the slot portions 301, 302, and 303 on the process cartridge, respectively, and thus the storage component disassembly tooling 300 can be positioned on the process cartridge. The free end of the protruding portion 372 of the support portion 370 is further provided with a hole portion 375. The storage component disassembly tooling 300 further includes a limiting portion 360 mounted on the hole portion 375. The limiting portion 360 is preferably a screw. Optionally, the limiting portion 360 may also be a pin, a key or the like. As shown in (a) and (b) of FIG. 29, the limiting portion 360 can move together with the support portion 370, and can abut against a limiting surface 390*a* of the positioning portion main body 399 to limit the support portion 370 from further moving in a direction away from the positioning portion 390, thereby avoiding the support portion 370 falling off from the storage component disassembly tooling 300 during transportation or when the user uses it.

Process of Assembling Storage Component Disassembly Tooling

The process of assembling the storage component disassembly tooling 300 of this embodiment is substantially the same as that of Embodiment 4 described above. The difference is that after the storage component disassembly tooling of Embodiment 4 described above is assembled, the storage component disassembly tooling 300 of this embodiment mounts the limiting portion 360 onto the hole portion 375 of the support portion 370 exposed through the opening 398 of the positioning portion 390. So far, the process of assembling the storage component disassembly tooling 300 has been completed.

Embodiment 6

Embodiment 6 of the present invention is introduced below. In order to better describe the working principle of the present invention, a direction of mounting a process cartridge into an electrophotographic imaging device is limited to a mounting direction P, and an extending direction of a developing roller in the process cartridge is set to an axial direction.

Figure 32:
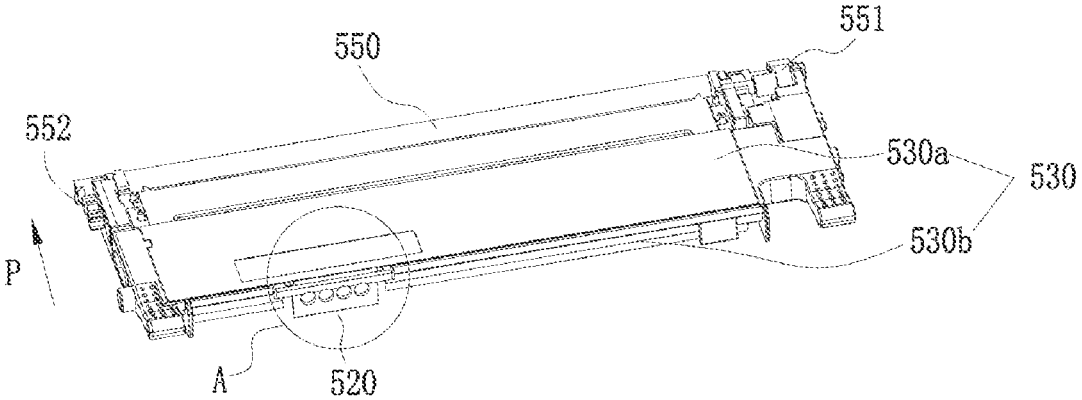
FIG. 32 is a schematic view of a process cartridge in a process cartridge set in Embodiment 6 of the present invention.

A process cartridge set of the present invention includes a process cartridge and a storage component disassembly tooling. The process cartridge of the present invention can be configured as shown in FIG. 32. The process cartridge includes a housing 530 containing a developer. The housing 530 includes an upper housing 530*a* and a lower housing 530*b*. A developing roller 550 is provided at a front end of the housing 530, and is used to deliver the developer to a photosensitive drum (not shown) in the electrophotographic imaging device. In the axial direction, an electric power receiving unit 552 is provided on a left side of the housing 530. In the mounting direction P, the electric power receiving unit 552 is closer to the front end of the housing 530 than a rear end of the housing 530, and is used to receive power from the electrophotographic imaging device and deliver it to the developing roller 550. In the axial direction, a driving force receiving unit 551 is provided on a right side of the housing 530. In the mounting direction P, the driving force receiving unit 551 is closer to the front end of the housing 530 than the rear end of the housing 530, and is used to receive a driving force from the electrophotographic imaging device to drive the developer roller 550 to rotate. The storage component mounting bracket 520 is disposed at the rear end of the housing 530 in the mounting direction P, and is closer to the electric power receiving unit 552 than the driving force receiving unit 551 in the axial direction.

Figure 33:
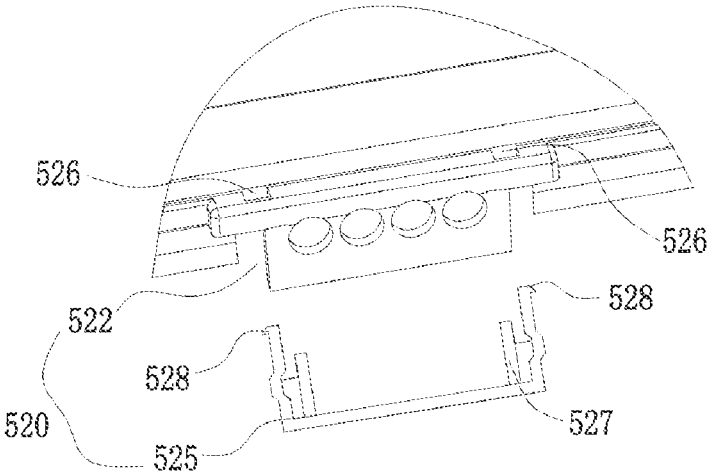
FIG. 33 is a partially exploded and enlarged schematic view of A in FIG. 32 in Embodiment 6 of the present invention.

In the process cartridge of the present invention, the storage component mounting bracket 520 is configured to allow the storage component to be detachably mounted therein, and is preferably configured into a structure as shown in FIG. 33. The storage component mounting bracket 520 includes an accommodating portion 522 and a storage component frame 525 is detachably mounted in the accommodating portion 522. The accommodating portion 522 is provided with an opening facing a lower end of the housing 530, so that the storage component frame 525 can be inserted into the accommodating portion 522 through the opening. The accommodating portion 522 is further provided with clamping slots 526 capable of fixing the storage component frame 525. Specifically, an accommodation slot 527 capable of accommodating the storage component is provided on the storage component frame 525, and the user can mount the storage component in the accommodation slot 527. Buckles 528 are further provided on the storage component frame 525. The buckles 528 are made of elastically deformed material, and can be inserted into the clamping slots 526, so that the storage component frame 525 mounted with the storage component can be fixed to the accommodating portion 522 through the buckles 528. In this embodiment, the user can easily take out the storage component frame 525 from the accommodating portion 522. The user only needs to gently press the buckles 528 to make the left and right buckles 528 deformed closer to each other, so that the buckles 528 can be separated from the clamping slots 526, and the storage component frame 525 can be taken out from the accommodating portion 522. If the storage component is mounted on the storage component frame 525, the user can easily take out the storage component frame 525 mounted with the storage component. If no storage component is mounted on the storage component frame 525, the user can also easily take out the storage component frame 525, and then mount the storage component taken out from the old process cartridge on the storage component frame 525. Of course, optionally, the storage component mounting bracket of the process cartridge of the present invention may also be configured as other structures, as long as it is convenient for the user to mount the storage component into it.

When the process cartridge set of the present invention is sold to users, the process cartridge therein is only provided with the storage component mounting bracket 520 capable of accommodating a storage component, but is not provided with the storage component. When the user needs to mount the process cartridge in the process cartridge set of the present invention into an electrophotographic imaging device, it needs to use the storage component disassembly tooling in the process cartridge set to take out the storage component of the old process cartridge in the prior art, and then mount it to a storage component mounting bracket 520 of a new process cartridge before loading it into the electrophotographic imaging device.

Figure 34:
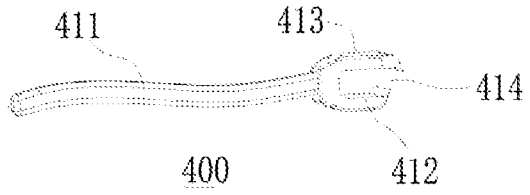
FIG. 34 is a schematic view of a storage component disassembly tooling in the process cartridge set in Embodiment 6 of the present invention.

Therefore, the storage component disassembly tooling in the process cartridge set of the present invention is designed so that it is convenient for the user to take out the storage component from the old process cartridge. It is preferably configured as a crowbar 400 as shown in FIG. 34. The crowbar 400 is preferably configured to be made of metal material, such as aluminum alloy, zinc alloy or magnesium aluminum alloy. Of course, it may also be made of other hard materials. The crowbar 400 integrally includes a grasping portion 411, a first jaw 412 and a second jaw 413. The first jaw 412 and the second jaw 413 are fixedly disposed relative to the grasping portion 411, and the first jaw 412 and the second jaw 413 are separated by a certain gap to form a prying opening 414 with a fixed gap. The second jaw 413 is located at an upper end of the first jaw 412 and is longer than the first jaw 412.

How the process cartridge set of the present invention works will be described in detail below in conjunction with a specific embodiment. The crowbar 400 in the preferred embodiment of the process cartridge and storage component disassembly tooling of the present invention will be used as an example to describe in detail how the process cartridge set of the present invention works. See FIGS. 33-38 for details.

Figure 31:
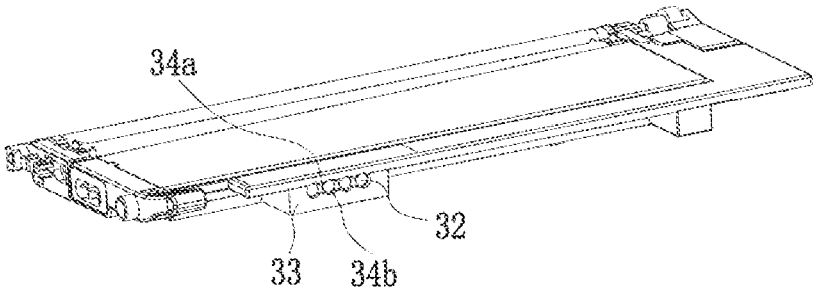
Fig. 31 (Prior Art)
FIG. 31 is a schematic view of a structure of an old process cartridge in the prior art.

After the user purchases the process cartridge set of the present invention, the old process cartridge that has been used can be taken out from the electrophotographic imaging device, and then, the crowbar 400 of the storage component disassembly tooling can be taken out from the process cartridge set of the present invention. It should be noted that the old process cartridge is generally configured to have a structure as shown in FIG. 31. The rear end of the old process cartridge is provided with a storage component 32 that can communicate information with the electrophotographic imaging device. The storage component 32 is accommodated in the accommodating portion 33 of the old process cartridge. The accommodating portion 33 is composed of a lower housing 34*b* and an upper housing 34*a* of the process cartridge together, wherein the storage component 32 is disposed in the lower housing 34*b*, and then the upper housing 34*a* covers the opening of the lower housing 34*b* to seal the storage component 32 at the rear end of the process cartridge, so that the storage component 32 will not fall off from the process cartridge, and the user cannot take out it from the process cartridge.

Figure 35:
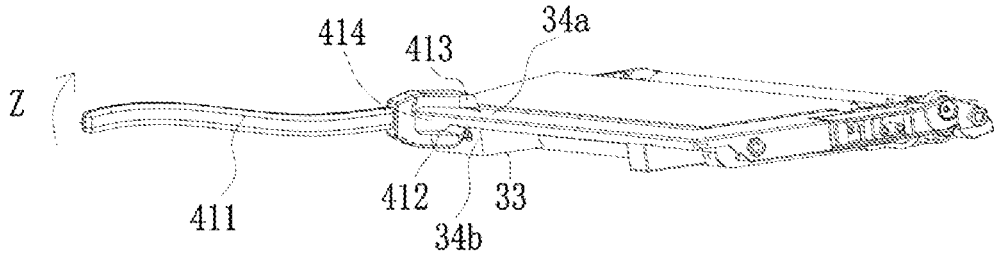
FIG. 35 is a schematic view of a user using the storage component disassembly tooling in FIG. 34 to take out a storage component of the old process cartridge in the prior art in Embodiment 6 of the present invention.
Figure 36:
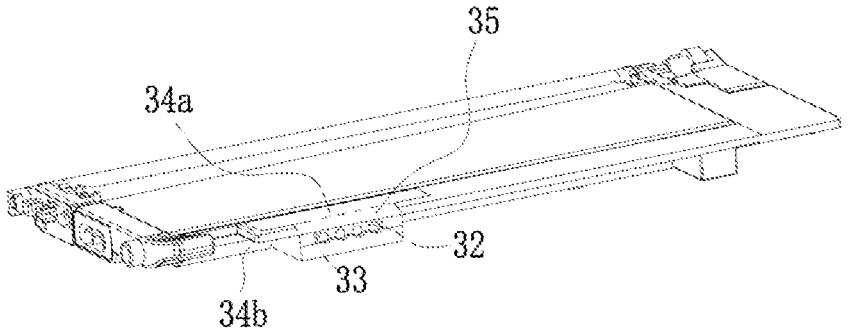
FIG. 36 is a schematic view after the user has used the storage component disassembly tooling in FIG. 34 to destroy an accommodating portion of the old process cartridge in the prior art in Embodiment 6 of the present invention.
Figure 37:
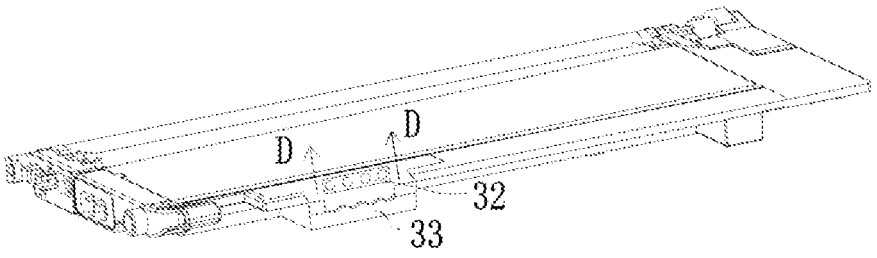
FIG. 37 is a schematic view when the user is taking out the storage components in the old process cartridge in Embodiment 6 of the present invention.
Figure 38:
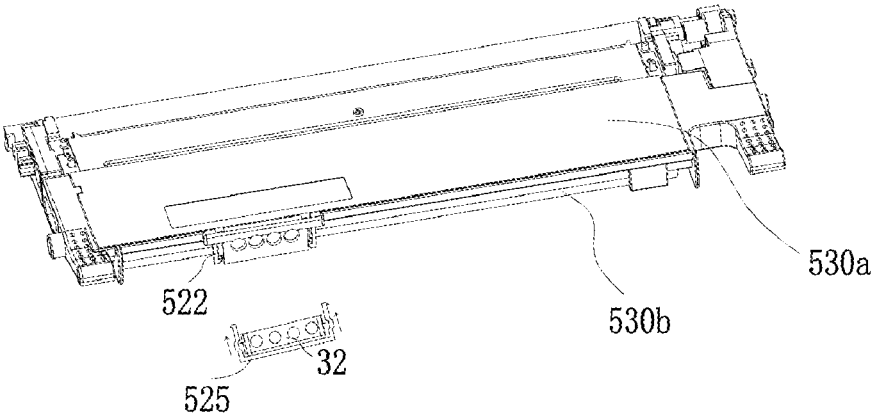
FIG. 38 is a schematic view of the user mounting the storage component in the old process cartridge to the process cartridge of the present invention in Embodiment 6 of the present invention.

As described above, after the user takes out the old process cartridge from the electrophotographic imaging device, the grasping portion 411 of the crowbar 400 is held by hand, and the opening 414 of the crowbar 400 is aligned with the accommodating portion 33 of the old process cartridge. Specifically, it can be inserted into the accommodating portion 33 of the old process cartridge as shown in FIG. 35. The first jaw 412 is inserted into an exposed part exposing the contact of the storage component in the accommodating portion 33 of the old process cartridge, the first jaw 412 is caused to abut against the bottom end of the corresponding upper housing 34*a* in the accommodating portion 33, and the second jaw 413 is caused to abut at the upper end of the upper housing 34*a* corresponding to the accommodating portion 33. Next, the user forcefully lifts up the crowbar 400 along a direction of Z shown in the figure. In this way, a part of the upper housing 34*a* covering the accommodating portion 33 will be separated from the lower housing 34*b* under the action of the crowbar 400, so that the upper end of the accommodating portion 33 is formed with an opening 35 as shown in FIG. 36. Therefore, the user can easily take out the storage component 32 in the old process cartridge by hand along a direction of D shown in FIG. 37. Then, as shown in FIG. 38, the user mounts the storage component 32 removed from the old process cartridge into a storage component frame 525 of a new process cartridge. Thereafter, the storage component frame 525 mounted with the storage component 32 is inserted into an accommodating portion 522 of the new process cartridge. Then, the new process cartridge equipped with the storage component 32 can be normally mounted into the electrophotographic imaging device and identified by the electrophotographic imaging device, thereby executing a printing task.

In the present invention, the user can easily mount the storage component 32 removed from the old process cartridge into the new process cartridge. A detachable storage component frame 525 is provided in the new process cartridge. The storage component frame 525 is configured to be detachably mounted to the rear end of the process cartridge. An accommodating slot 527 capable of accommodating the storage component 32 is provided on the storage component frame 525. Moreover, buckles 528 are further provided on the storage component frame 525. When the storage component frame 525 needs to be taken out from the process cartridge, the user only needs to gently move the buckles 528 so as to move two buckles 528 closer to each other, and the storage component frame 525 can be taken out from the rear end of the process cartridge. Then, the user mounts the storage component 32 in the accommodating slot 527. After the storage component frame 525 mounted with the storage component 32 is mounted at the rear end of the process cartridge again, the process cartridge can be normally mounted into the electrophotographic imaging device. As a simple modification of the process cartridge of the present invention, the detachably mounted storage component frame may not be provided, as long as the storage component can be easily mounted into or taken out from the housing.

The process cartridge set of the present invention can conveniently allow users to take out the storage component in the old process cartridge, and then the old storage component taken out is mounted into a new process cartridge. The process cartridge equipped with the old storage component can be recognized by the imaging device again, thereby smoothly completing the printing task. The process cartridge set of the present invention can effectively use the storage component in the old process cartridge and save the user's cost of using the new process cartridge. At the same time, the storage component disassembly tooling in the process cartridge set can also be used as other tools after the storage component of the old process cartridge is taken out, improving the customer's use experience. Therefore, the process cartridge set of the present invention is simple in structure, convenient to use, economical and practical, and can greatly save the customer's use cost. Moreover, it realizes recycling of parts of the old process cartridge, which does not cause waste of old storage components, and saves social resources. At the same time, when the process cartridge set of the present invention is sold as a commodity, the customers can realize the self-operation and recycling of the old process cartridge, which provides the customers with a kind of DIY fun and increases the interest of the users in the use process.

Embodiment 7

Figure 39:
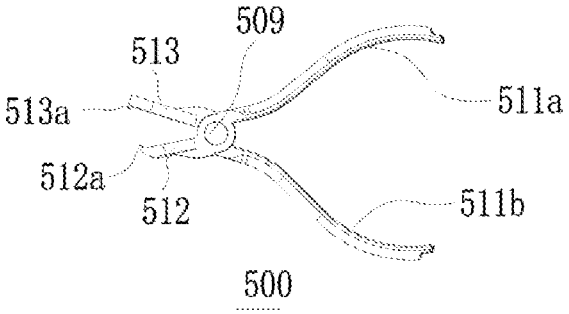
FIG. 39 is a schematic view of a storage component disassembly tooling in a process cartridge set in Embodiment 7 of the present invention.
Figure 40:
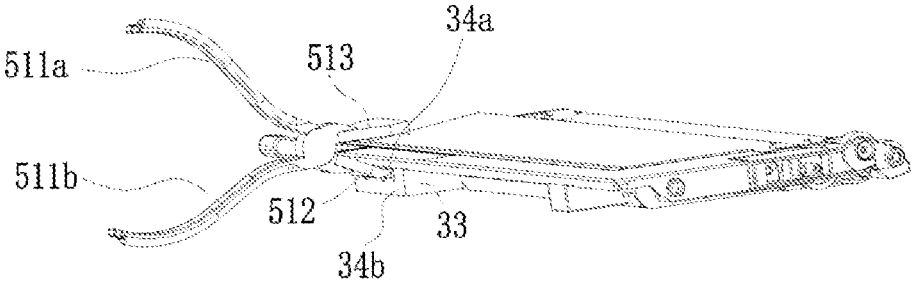
FIG. 40 is a schematic view of the user using the storage component disassembly tooling in the process cartridge set of the present invention to take out the storage component of the old process cartridge in the prior art in Embodiment 7 of the present invention.

In the process cartridge set of the present invention, a preferred embodiment of the storage component disassembly tooling is a crowbar 400, However, optionally, the storage component disassembly tooling may also be configured as other structures, such as pliers 500 as shown in FIGS. 39-40. The pliers 500 include a first grasping portion 511*a* and a second grasping portion 511*b*. The other end of the first grasping portion 511*a* is provided with a first jaw 512. The other end of the second grasping portion 511*b* is provided with a second jaw 513. The user can hold the first grasping portion 511*a* and the second grasping portion 511*b* by hand and rotate around a center of rotation 509 so that the first jaw 512 and the second jaw 513 rotate with the rotation of the first grasping portion 511*a* and the second grasping portion 511*b*. As a result, the first jaw 512 and the second jaw 513 are switched between two states: open and closed.

Figure 41:
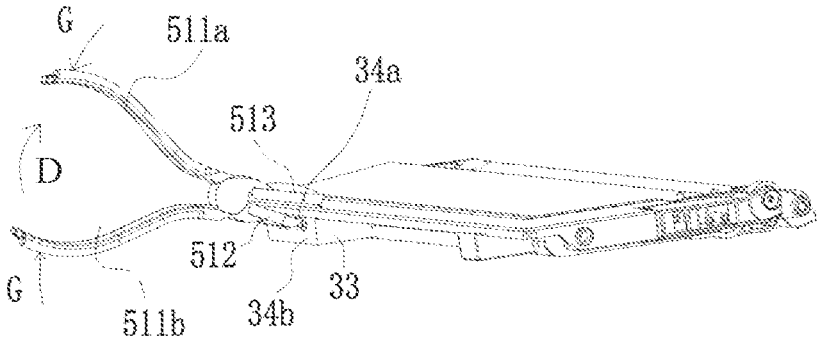
FIG. 41 is another schematic view of the user using the storage component disassembly tooling in the process cartridge set of the present invention to take out the storage component of the old process cartridge in the prior art in Embodiment 7 of the present invention.

When the user needs to use the pliers 500 to take out the storage component 32 from the old process cartridge 30, the first grasping portion 511*a* and the second grasping portion 511*b* of the pliers 500 are held. First, the first jaw 512 and the second jaw 513 are caused to be in the open state, and the first jaw 512 in the open state is inserted into the accommodating portion 33 of the old process cartridge. The first jaw 512 is inserted into the exposed part of the accommodating portion 33 of the old process cartridge that exposes the contact of the storage component, and the first jaw 512 is caused to abut against the bottom end of the corresponding upper housing 34*a* in the accommodating portion 33. Then, the user applies force to the first grasping portion 511*a* and the second grasping portion 511*b* in a direction of G as shown in FIG. 41, so that the first jaw 512 and the second jaw 513 of the pliers are closed. At this time, the second jaw 513 abuts against the upper housing 34*a* of the old process cartridge. Thereafter, the user applies force to the pliers during holding the first grasping portion 511*a* and the second grasping portion 511*b* simultaneously, so that the pliers as a whole rotate along a direction of D. During this rotation, a front end 513*a* of the second jaw 513 abuts at the upper end of the upper housing 34*a*. Since the second jaw 513 is longer than the first jaw 512, during the rotation, the pliers 500 rotate with the front end 513*a* of the second jaw 513 as a fulcrum. The user applies force to make the pliers rotate along the D direction. At this time, the front end 512*a* of the first jaw 512 is inclined forward, and it will abut against the upper housing 34*a* tightly. During the rotation of the pliers 500, a part of the upper housing 34*a* covering the accommodating portion 33 will be separated from a surface of the lower housing 34*b* with the rotation of the first jaw 512. During the entire rotation of the pliers 500, only a part of the upper housing 34*a* located above the accommodating portion 33 will be separated from the lower housing 34*b*, and an opening 35 as shown in FIG. 36 of Embodiment 6 is formed, so that the user can take out the storage component and mount it into a new process cartridge in the same manner as in Embodiment 6.

Embodiment 8

Figure 42:
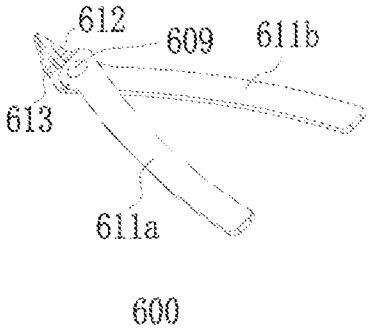
FIG. 42 is a schematic view of a storage component disassembly tooling in a process cartridge set in Embodiment 8 of the present invention.

The storage component disassembly tooling in the process cartridge set of the present invention may also be configured as second pliers 600 as shown in FIG. 42. The second pliers 600 include a third grasping portion 611*a* and a fourth grasping portion 611*b*. The other end of the third grasping portion 611*a* is provided with a third jaw 612. The other end of the fourth grasping portion 611*b* is provided with a fourth jaw 613. The third grasping portion 511*a* and the fourth grasping portion 511*b* can rotate around a center of rotation 609, so that the third jaw 612 and the fourth jaw 613 can be switched between two states: open and closed. In this embodiment, the manner in which the user takes out the storage component from the old process cartridge is different from the manner in the foregoing embodiments. When the user needs to take out the storage components in the old process cartridge, he only needs to hold the third grasping portion 511*a* and the fourth grasping portion 511*b* by hand. The second pliers 600 can rotate around the center of rotation 609, so that the third jaw 612 and the fourth jaw 613 are open. As a result, the user inserts the jaws into the accommodating portion to expose the surroundings of the storage component, so that the third jaw 612 and fourth jaw 613 being open clamp an outer peripheral plastic part of the exposed part of the storage component, and forcefully cut it off bit by bit. Therefore, a large gap is exposed in the accommodating portion, thereby exposing the storage component in the old process cartridge. The user can easily take out the storage component. The removed storage component can be mounted into a new process cartridge in the manner in the embodiment. As a result, the new process cartridge equipped with old storage component can be mounted into the electrophotographic imaging device to complete an image forming task.

With the second pliers in this embodiment, the user can only destroy part of the structure of the accommodating portion without destroying the structure of other parts of the housing, and the accommodating portion of the process cartridge is not destroyed, so that the developer will not leak out and pollute the environment. Moreover, the box process cartridge can be further recycled, so that resources can be effectively used. The removed old storage component is directly inserted into an accommodating portion of a new process cartridge, and then the new process cartridge mounted with the old storage component is mounted into the electrophotographic imaging device to complete a normal printing function.

Method of Disassembling Storage Component Using Storage Component Disassembly Tooling In Embodiment 1, as shown in FIGS. 3 and 6-9, a method of disassembling the storage component 215 using the storage component disassembly tooling 210 includes at least the following steps: step 1: causing the cutting portion 213 to insert the prying portion 214 at one end in the longitudinal direction of the support portion 211 into any one of the grooves 224 on the lower side of the storage component mounting bracket 220 in a direction facing the supporting portion 223; and step 2: holding the other end of the support portion 211 in the longitudinal direction and applying force in a rotation direction M around the fulcrum portion 216, so that the prying portion 214 rotates around the fulcrum portion 216 in the same rotation direction N as the rotation direction M. At this time, the cutting portion 213 on the prying portion 214 squeezes the supporting portion 223 of the storage component mounting bracket 220, so that the storage component mounting bracket 220 is deformed. Because the cured epoxy resin glue has the characteristics of easy cracking and vitrification after being stressed, the deformed storage component mounting bracket 220 squeezes the epoxy resin glue, so that the epoxy resin glue is stressed and cracked, the adhesion is greatly reduced, and one side of the storage component 215 is pushed out. When the disassembled storage component 215 needs to be mounted, if the storage component 215 is not adhered with residual epoxy resin glue, then the storage component 215 can be directly mounted onto another process cartridge; and if the storage component 215 is adhered with residual epoxy resin glue, then the following cleaning operations are performed: a cutting plier may be used to cut off the epoxy resin glue adhered on the storage component 215, and after cleaning, the storage component 215 may be mounted onto another process cartridge. Optionally, the cutting plier used in the above cleaning operation is not necessary, and the disassembled storage component 215 may be placed on the polishing portion 212 for polishing to remove the epoxy resin glue adhered on the storage component 215. That is, using the polishing portion 212 can also clean the storage component 215.

The disassembly methods of Embodiment 2 and Embodiment 3 are substantially the same as that of Embodiment 1, and will not be repeated here.

In Embodiment 4, as shown in FIGS. 15-25, the method of disassembling the storage component 15 using the storage component disassembly tooling 100 is as follows: after the storage component disassembly tooling 100 is correctly mounted onto the process cartridge, the handle 71 of the support portion 70 is rotated; as the amount of engagement between the external thread 73 on the support portion 70 and the internal thread 97 on the positioning portion 90 gradually increases, the cutting portion 86 of the drilling portion 80 gradually enters the groove 24 of the storage component mounting bracket 20; as the amount of engagement further increases, the cutting portion 86 of the drilling portion 80 gradually cuts into the storage component mounting bracket 20 located on the lower side of the storage component 15 in the direction from front to rear; and as the amount of engagement further increases, the cylindrical portion 82 of the drilling portion 80 squeezes the storage component mounting bracket 20 to make the storage component mounting bracket 20 be deformed, and the epoxy resin glue adhered on the storage component mounting bracket 20 is deformed and cracked due to the deformation of the storage component mounting bracket 20, so that the adhesion of the epoxy resin glue is greatly reduced. At this time, the storage component 15 is pushed out from the storage component mounting bracket 20. So far, the storage component 15 has been disassembled.

The disassembly method of Embodiment 5 is substantially the same as that of Embodiment 4 described above, and will not be repeated here.

In summary, the method of disassembling the storage component using the storage component disassembly tooling of the present invention includes at least the following steps:

step 1: a step of causing the cutting portion to enter the groove of the storage component mounting bracket;

step 2: a step of applying force to the support portion to make the cutting portion squeeze the storage component mounting bracket; and step 3: a step of pushing out the storage component from the storage component mounting bracket.

Beneficial Effects of the Invention

The storage component disassembly tooling of the present invention cuts into or squeezes the storage component mounting bracket through the cutting portion, so that the storage component mounting bracket can be deformed, and the epoxy resin glue adhered on the storage component are stressed and then cracked, and thus the storage component can be pushed out. The storage component disassembly tooling provided by the present invention not only has simple operation, shortens the disassembly time of the storage component, improves the disassembly efficiency, and saves time and labor. Moreover, the storage component disassembly tooling has a relatively simple structure, and the manufacturing difficulty and manufacturing cost are relatively low.

It should be noted that the storage component disassembly tooling in each of Embodiments 1-5 provided by the present invention is drilled into the storage component mounting bracket so as to destroy a part of the plastic part of the storage component mounting bracket. Specifically, in Embodiments 1 to 3, it is drilled into the storage component by using the prying portion to cut into the storage component mounting bracket, so as to destroy the supporting portion in the storage component mounting bracket that supports the storage component. In Embodiments 4 and 5, it is drilled into the storage component mounting bracket by using the drilling portion similar to a drill, so as to destroy the supporting portion in the storage component mounting bracket that supports the storage component. The drilling manner should be understood as drilling at least a part of the storage component disassembly tooling into the plastic part of the storage component mounting bracket so as to destroy the plastic part. The prying portion and the drilling portion described above are summarized as the drilling portion of the storage component disassembly tooling that can be drilled into the plastic material of the storage component mounting bracket. Preferably, the drilling portion is drilled into the supporting portion of the storage component mounting bracket that supports the storage component so as to destroy the plastic material at the supporting portion, so that the storage component can be easily and quickly pushed out by the storage component disassembly tooling with good effect.

The above embodiments are only used to illustrate the technical solutions of the present invention, but not to limit them. Although the present invention has been described in detail with reference to the foregoing embodiments, those of ordinary skill in the art should understand that: the technical solutions set forth in the foregoing embodiments are still modified, or some of the technical features therein are equivalently replaced. Moreover, these modifications or replacements do not cause the essence of the corresponding technical solutions to deviate from the spirit and scope of the technical solutions of the embodiments of the present invention.

What is claimed is:

1. A storage component disassembly tooling, for disassembling a storage component on a process cartridge, the process cartridge comprising a housing and a storage component mounting bracket on the housing for supporting the storage component, the storage component disassembly tooling comprising:

a drilling portion, and a positioning portion;

wherein the positioning portion is configured to position the storage component disassembly tooling on the housing of the process cartridge, and the drilling portion is configured to move relative to the positioning portion to destroy at least a part of the storage component mounting bracket.

2. The storage component disassembly tooling according to claim 1, wherein the drilling portion comprises a cutting portion having a cutter edge, and the cutting portion is configured to destroy the part of the storage component mounting bracket using the cutter edge.

3. The storage component disassembly tooling according to claim 2, wherein the cutter edge is configured to destroy the part of the storage component mounting bracket by cutting into the storage component mounting bracket in a non-rotating posture.

4. The storage component disassembly tooling according to claim 2, wherein the drilling portion further comprises a squeezing portion configured to push the storage component out of the storage component mounting bracket.

5. The storage component disassembly tooling according to claim 4, wherein the cutter edge has a cutter tip, and the cutter tip and the squeezing portion are transitioned by an inclined surface.

6. The storage component disassembly tooling according to claim 4, wherein the storage component mounting bracket comprises a support portion for supporting the storage component, and when the storage component disassembly tooling is positioned on the process cartridge, at least a part of the squeezing portion is located on a downstream side of the support portion along an arrangement direction of the support portion and the storage component when viewed along a direction perpendicular to a thickness direction of the storage component.

7. The storage component disassembly tooling according to claim 2, wherein the positioning portion further comprises a bonding portion configured to bond to the housing of the process cartridge, and configured to prevent the positioning portion from displacing relative to the housing when the cutting portion destroys the storage component mounting bracket.

8. The storage component disassembly tooling according to claim 1, further comprising an opening, wherein when the storage component disassembly tooling is positioned on the housing, the storage component is exposed through the opening.

9. The storage component disassembly tooling according to claim 1, further comprising a handle and an external thread connected to the handle, wherein the positioning portion comprises an internal thread matching the external thread, and wherein the handle, when rotated, is configured to cause the external thread to engage the internal thread and force the drilling portion to drill into the storage component mounting bracket.

10. The storage component disassembly tooling according to claim 9, wherein the handle and the external thread are connected and form a T-shaped structure.

11. The storage component disassembly tooling according to claim 1, further comprising a polishing portion having a rough surface for polishing the storage component removed from the process cartridge.

* * * * *